US012338575B2

(12) United States Patent
Ishii et al.

(10) Patent No.: US 12,338,575 B2
(45) Date of Patent: Jun. 24, 2025

(54) SHEET MATERIAL AND METHOD FOR PRODUCING SAME

(71) Applicant: Toray Industries, Inc., Tokyo (JP)

(72) Inventors: Koki Ishii, Osaka (JP); Ryuji Shikuri, Gifu (JP); Takuya Shibano, Otsu (JP)

(73) Assignee: Toray Industries, Inc., Tokyo (JP)

( * ) Notice: Subject to any disclaimer, the term of this patent is extended or adjusted under 35 U.S.C. 154(b) by 314 days.

(21) Appl. No.: 17/784,749

(22) PCT Filed: Dec. 10, 2020

(86) PCT No.: PCT/JP2020/046006
§ 371 (c)(1),
(2) Date: Jun. 13, 2022

(87) PCT Pub. No.: WO2021/125029
PCT Pub. Date: Jun. 24, 2021

(65) Prior Publication Data

US 2023/0009350 A1 Jan. 12, 2023

(30) Foreign Application Priority Data

Dec. 20, 2019 (JP) ..... 2019-230228
Mar. 19, 2020 (JP) ..... 2020-049011
May 26, 2020 (JP) ..... 2020-091118

(51) Int. Cl.
*D06N 3/00* (2006.01)
*D06N 3/12* (2006.01)

(52) U.S. Cl.
CPC ..... *D06N 3/0004* (2013.01); *D06N 3/0011* (2013.01); *D06N 3/0063* (2013.01);
(Continued)

(58) Field of Classification Search
None
See application file for complete search history.

(56) References Cited

U.S. PATENT DOCUMENTS 4,028,310 A * 6/1977 Schafer ..... C08G 18/831 528/902
11,441,260 B2 9/2022 Furui et al.
(Continued)

FOREIGN PATENT DOCUMENTS

CN 110506141 A 11/2019
JP 2011214210 A 10/2011
(Continued)

OTHER PUBLICATIONS

Chinese Office Action for Chinese Application No. 202080086970.1, issued Aug. 22, 2023 with translation, 10 pages.
(Continued)

*Primary Examiner* — Arti Singh-Pandey
(74) *Attorney, Agent, or Firm* — Buchanan Ingersoll & Rooney PC

(57) ABSTRACT

The sheet material according to the present invention has a polymer elastic body and a fibrous base material comprising ultrafine fibers, wherein the average single fiber diameter of the ultrafine fibers is 0.1 μm to 10.0 μm, the polymer elastic body has a hydrophilic group and an N-acylurea bond and/or an isourea bond, and the following conditions are satisfied: the longitudinal stiffness, in accordance with method A (45° cantilever method) in the text of "8.21 Stiffness" of JIS L 1096:2010 "Testing Methods for Woven and Knitted Fabrics", is 40 mm to 140 mm; and after immersion for 24 hours in N,N-dimethylformamide, the following are obtained in wear testing using a pressing load of 12.0 kPa and 20,000 friction cycles in accordance with method E (Martindale method) in the text of "8.19 Wear Strength and Friction Discoloration" of JIS L 1096:2010 "Testing Methods for Woven and Knitted Fabrics": a grade of at least 4 and a wear loss of not more than 25 mg.

15 Claims, 1 Drawing Sheet

(52) U.S. Cl.
CPC ..... *D06N 3/121* (2013.01); *D06N 2201/02* (2013.01); *D06N 2209/128* (2013.01); *D06N 2209/1635* (2013.01); *D06N 2209/1685* (2013.01); *D06N 2211/06* (2013.01); *D06N 2211/10* (2013.01); *D06N 2211/14* (2013.01); *D06N 2211/263* (2013.01); *D06N 2211/265* (2013.01); *D06N 2211/267* (2013.01)

(56) References Cited

U.S. PATENT DOCUMENTS

| | | | | |
|---|---|---|---|---|
| 2013/0005848 | A1 | 1/2013 | Koide et al. | |
| 2015/0233050 | A1 | 8/2015 | Koide et al. | |
| 2020/0149216 | A1 | 5/2020 | Murahara et al. | |
| 2022/0380976 | A1* | 12/2022 | Shibano ..... | D06N 3/0034 |
| 2023/0407558 | A1* | 12/2023 | Shibano ..... | D06M 15/333 |

FOREIGN PATENT DOCUMENTS

| | | | | |
|---|---|---|---|---|
| JP | 2013112905 | A | * | 6/2013 |
| WO | 2013065608 | A1 | | 5/2013 |
| WO | 2014042241 | A1 | | 3/2014 |
| WO | 2015129602 | A1 | | 9/2015 |
| WO | 2021125029 | A1 | | 6/2021 |

OTHER PUBLICATIONS

International Search Report and Written Opinion for International Application No. PCT/JP2020/046006, dated Feb. 9, 2021, 6 pages.

* cited by examiner

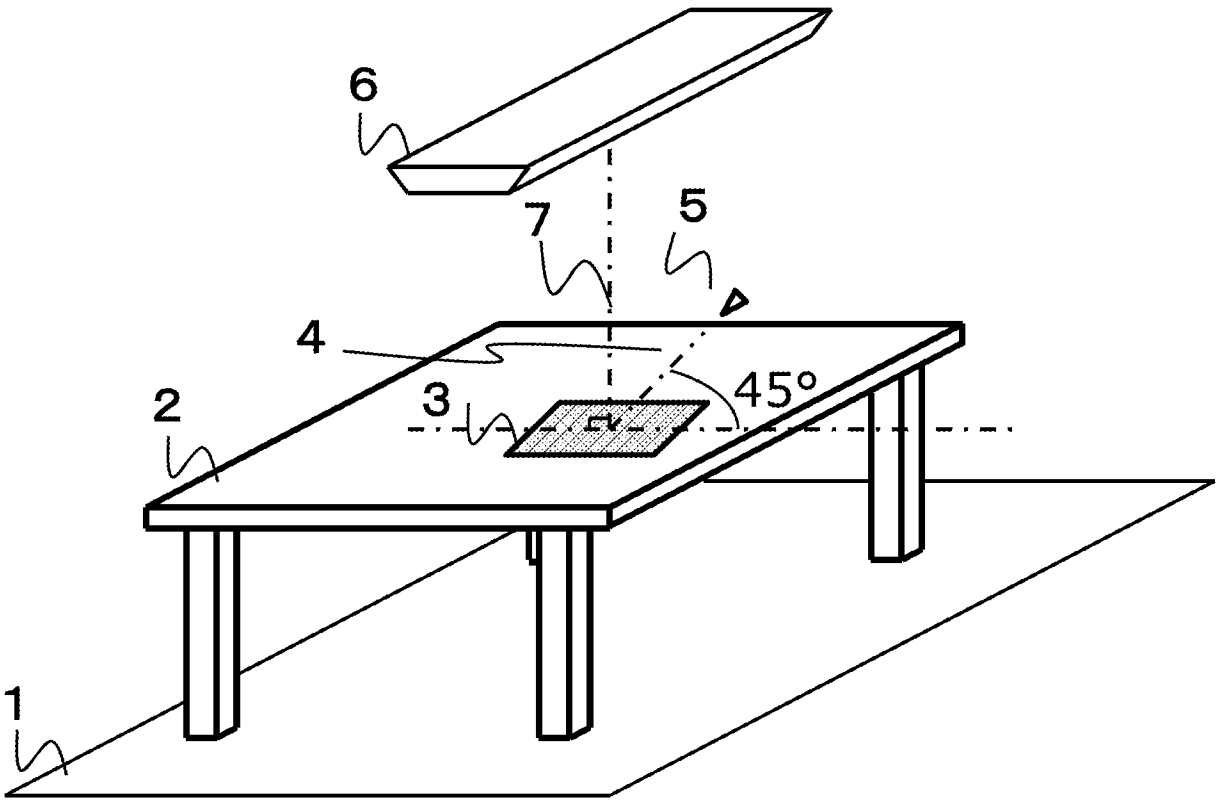
6
7
5
4
45°
3
2
1

SHEET MATERIAL AND METHOD FOR PRODUCING SAME

CROSS REFERENCE TO RELATED APPLICATIONS

This is the U.S. National Phase application of PCT/JP2020/046006, filed Dec. 10, 2020, which claims priority to Japanese Patent Application No. 2019-230228, filed Dec. 20, 2019, Japanese Patent Application No. 2020-049011, filed Mar. 19, 2020, and Japanese Patent Application No. 2020-091118, filed May 26, 2020, the disclosures of each of these applications being incorporated herein by reference in their entireties for all purposes.

TECHNICAL FIELD OF THE INVENTION

The present invention relates to a sheet material and a method for producing the same, and particularly to a sheet material excellent in flexibility, chemical resistance, and dyeing resistance and a method for producing the same.

BACKGROUND OF THE INVENTION

Sheet materials mainly including a fibrous base material and polyurethane such as a nonwoven fabric have superior characteristics not shared with natural leather, and are widely used for various applications such as artificial leather. In particular, a sheet material that employs a polyester-based fibrous base material is excellent in formability, and therefore its use has spread year by year to clothing, chair upholstery, automotive interior finishing material, or the like.

In order to manufacture such a sheet material, a combination of steps has been generally adopted, including: impregnating a fibrous base material with a polyurethane-containing organic solvent solution; and then immersing the obtained fibrous base material in an aqueous solution containing water or an organic solvent in which polyurethane is not dissolved, thereby subjecting the polyurethane to wet coagulation. In this case, as the organic solvent which is a polyurethane solvent, a water-miscible organic solvent such as N,N-dimethylformamide (hereinafter, may also be referred to as "DMF") is used. However, since the organic solvents are highly harmful to a human body and the environment in general, a procedure without using any organic solvent has been strongly sought in manufacturing the sheet material.

As a specific solution, a method has been considered in which a water-dispersed polyurethane prepared by dispersing a polyurethane resin into water is used as an alternative for the known organic solvent-based polyurethane. So far, in order to obtain a sheet material having a soft texture using water-dispersed polyurethane, for example, a method has been proposed in which a water-dispersed polyurethane liquid containing a blowing agent is added to a fibrous base material such as a sheet made of a fabric such as a nonwoven fabric, a gas is generated in the polyurethane by heating, and a structure of the polyurethane in the fibrous base material has a porous structure (refer to Patent Document 1).

In addition, a method has been proposed in which a water-dispersed polyurethane liquid containing a blowing agent is added to a fibrous base material containing ultrafine fiber-generating fibers, and then ultrafine fibers are generated from the ultrafine fiber-generating fibers, and then the water-dispersed polyurethane liquid is added again (refer to Patent Document 2).

Furthermore, a method has been proposed in which a fibrous base material is impregnated in a solution containing a water-dispersed polyurethane and a thickener, the fibrous base material is immersed in hot water to reduce the size of a polyurethane resin, and a gripping force of an entangled portion of the fiber by the water-dispersed polyurethane is reduced (refer to Patent Document 3).

PATENT DOCUMENTS

Patent Document 1: Japanese Patent Laid-open Publication No. 2011-214210

Patent Document 2: International Publication No. 2013/065608

Patent Document 3: International Publication No. 2015/129602

SUMMARY OF THE INVENTION

Unfortunately, a sheet material has a problem that the texture tends to be hard, the material produced by impregnating a fibrous base material in a water-dispersed polyurethane dispersion in which water-dispersed polyurethane has been dispersed in liquid and then coagulating the polyurethane.

One of the main reasons is a difference in the coagulation method between the two. That is, the coagulation method of an organic solvent-based polyurethane liquid is a so-called wet coagulation method in which polyurethane molecules dissolved in the organic solvent are coagulated by solvent substitution with water, and a porous film having a low density is formed when viewed from a polyurethane film. Therefore, even when the fibrous base material is impregnated with polyurethane and solidified, a bonding area between fiber and polyurethane is reduced, and a soft sheet material is obtained.

On the other hand, in the water-dispersed polyurethane, a so-called wet heat solidification method in which a hydrated state of a water-dispersed polyurethane dispersion is collapsed by heating and polyurethane emulsions are aggregated to be solidified is mainly used, and a polyurethane film structure to be obtained is a pore-free film having a high density. Therefore, adhesion between the fibrous base material and the polyurethane becomes dense, and the entangled portion of the fiber is strongly gripped, so that the texture becomes hard.

In the method disclosed in Patent Document 1, by making the water-dispersed polyurethane porous, the bonding area between the fibers and the polyurethane is reduced, a gripping force at an entanglement point of the fibers is weakened, and it is possible to obtain a sheet material having a good texture with a soft touch, but the flexibility tends to be still poor as compared with a case of adding the organic solvent-based polyurethane.

In addition, in a method disclosed in Patent Document 2, durability is excellent due to the addition of polyurethane in two steps, but the flexibility tends to be still poor as compared with the case where the organic solvent-based polyurethane is added.

Meanwhile, in a method disclosed in Patent Document 3, by making the water-dispersed polyurethane porous, the bonding area between the fibers and the polyurethane is reduced, a gripping force at an entanglement point of the fibers is weakened, and it is possible to obtain a sheet material having a good texture with a soft touch, but the flexibility tends to be still poor as compared with a case of adding the organic solvent-based polyurethane. However, since a divalent cation-containing inorganic salt is used as a thermal coagulation modifier, the occurrence of impregnation unevenness due to gelation of the impregnation liquid is a problem.

In addition, in the methods disclosed in these patent documents, since the water-dispersed polyurethane swells in a solvent to weaken the gripping force at the entanglement point of the fibers, the sheet material cannot be strongly gripped, and thus there is a problem in chemical resistance and dyeing resistance.

Therefore, in view of the background of the related art, an object of the present invention is to provide a sheet material excellent in flexibility, chemical resistance, and dyeing resistance, and a method for producing the same.

As a result of intensive studies to achieve the above object, the present inventors have found that flexibility, chemical resistance, and dyeing resistance can be improved by causing the elastomer to have a specific functional group by, for example, producing a sheet material through a first elastomer precursor impregnation step, an ultrafine fiber generating step, and a second elastomer impregnation step. Further, it has been found that the sheet material can reduce the amount of fiber fragments during washing.

The present invention has been completed based on these findings, and according to the present invention, the following inventions are provided.

The sheet material of the present invention has an elastomer and a fibrous base material comprising ultrafine fibers, wherein an average single-fiber diameter of the ultrafine fibers is 0.1 μm or more and 10.0 μm or less, the elastomer has a hydrophilic group and an N-acylurea bond and/or an isourea bond, and the following condition 1 and condition 2 are satisfied:

condition 1: A longitudinal stiffness, in accordance with method A (45° cantilever method) in the text of "8.21 Stiffness" of JIS L 1096:2010 "Testing Methods for Woven and Knitted Fabrics", is 40 mm or more and 140 mm or less; and condition 2: After immersion for 24 hours in N,N-dimethylformamide, the following are obtained in wear testing using a pressing load of 12.0 kPa and 20,000 friction cycles in accordance with method E (Martindale method) in the text of "8.19 Wear Strength and Friction Discoloration" of JIS L 1096:2010 "Testing Methods for Woven and Knitted Fabrics": a grade of at least 4 and a wear loss of not more than 25 mg.

According to a preferable aspect of the sheet material of the present invention, the elastomer includes two types of an elastomer A and an elastomer B different from the elastomer A.

According to a preferable aspect of the sheet material of the present invention, a wet tensile strength of the sheet material is 75% or more of a dry tensile strength of the sheet material.

According to a preferable aspect of the sheet material of the present invention, a wet tensile strength and elongation of the sheet material is 100% or more of a dry tensile strength and elongation of the sheet material.

According to a preferable aspect of the sheet material of the present invention, the sheet material further satisfies the following condition 3:

condition 3: The sheet material has an L value retention of 90% or more and 100% or less when a nap raising surface of the sheet material is placed on a hot plate heated to 150° C. and pressed at a pressing load of 2.5 kPa for 10 seconds.

According to a preferable aspect of the sheet material of the present invention, the sheet material further satisfies the following condition 4:

condition 4: In a washing test according to the ISO 6330 C4N method, when the washing test of one sheet of the sheet material is performed, and fiber fragments attached to a collecting bag attached to a drain hose is collected using a membrane filter after the test, the amount of the fiber fragment is 10.0 (mg/sheet material 100 $cm^2$) or less.

A method for producing a sheet material of the present invention includes the following steps (1) to (3) in this order.

(1) A first elastomer precursor impregnation step of forming an elastomer by impregnating a fibrous base material made of ultrafine fiber-generating fibers with an aqueous dispersion containing an elastomer precursor having a hydrophilic group, a monovalent cation-containing inorganic salt, and a crosslinker, and then subjecting the fibrous base material impregnated with the aqueous dispersion to a heat drying treatment at a temperature of 100° C. or higher and 180° C. or lower, wherein a content of the monovalent cation-containing inorganic salt in the aqueous dispersion is 10 parts by mass or more and 100 parts by mass or less with respect to 100 parts by mass of the elastomer precursor.

(2) An ultrafine fiber generating step of generating ultrafine fibers from the ultrafine fiber-generating fibers to form a fibrous base material made of the ultrafine fibers.

(3) A second elastomer precursor impregnation step of further forming an elastomer by impregnating a fibrous base material made of the ultrafine fibers with an aqueous dispersion containing an elastomer precursor having a hydrophilic group, a monovalent cation-containing inorganic salt, and a crosslinker, and then subjecting the fibrous base material impregnated with the aqueous dispersion to a heat drying treatment at a temperature of 100° C. or higher and 180° C. or lower, wherein a content of the monovalent cation-containing inorganic salt in the aqueous dispersion is 10 parts by mass or more and 100 parts by mass or less with respect to 100 parts by mass of the elastomer precursor.

According to a preferable aspect of the method for producing a sheet material of the present invention, the elastomer precursor used in the first elastomer precursor impregnation step and the elastomer precursor used in the second elastomer precursor impregnation step are the same elastomer precursor.

According to a preferable aspect of the method for producing a sheet material of the present invention, the elastomer precursor contains polyether diol and/or polycarbonate diol.

According to a preferable aspect of the method for producing a sheet material of the present invention, the elastomer precursor used in the first elastomer precursor impregnation step is an elastomer precursor A and the elastomer precursor used in the second elastomer precursor impregnation step is an elastomer precursor B different from the elastomer precursor A.

According to a preferable aspect of the method for producing a sheet material of the present invention, the elastomer precursor A contains polyether diol as a constituent.

According to a preferable aspect of the method for producing a sheet material of the present invention, the elastomer precursor B contains polycarbonate diol as a constituent.

According to a preferable aspect of the method for producing a sheet material of the present invention, the crosslinker is a carbodiimide-based crosslinker and/or a blocked isocyanate crosslinker.

According to a preferable aspect of the method for producing a sheet material of the present invention, the monovalent cation-containing inorganic salt is sodium chloride and/or sodium sulfate.

According to the present invention, a sheet material excellent in flexibility, chemical resistance, and dyeing resistance is obtained.

BRIEF DESCRIPTION OF THE DRAWING

The figure is a conceptual perspective view illustrating a method for evaluating a surface appearance of a sheet material according to the present invention.

DETAILED DESCRIPTION OF EMBODIMENTS OF THE INVENTION

The sheet material of the present invention has an elastomer and a fibrous base material comprising ultrafine fibers, wherein an average single-fiber diameter of the ultrafine fibers is 0.1 μm or more and 10.0 μm or less, the elastomer has a hydrophilic group and an N-acylurea bond and/or an isourea bond, and the following condition 1 and condition 2 are satisfied:

condition 1: A longitudinal stiffness, in accordance with method A (45° cantilever method) in the text of "8.21 Stiffness" of JIS L 1096:2010 "Testing Methods for Woven and Knitted Fabrics", is 40 mm or more and 140 mm or less; and condition 2: After immersion in N,N-dimethylformamide, the following are obtained in wear testing using a pressing load of 12.0 kPa and 20,000 friction cycles in accordance with method E (Martindale method) in the text of "8.19 Wear Strength and Friction Discoloration" of JIS L 1096:2010 "Testing Methods for Woven and Knitted Fabrics": a grade of at least 4 and a wear loss of not more than 25 mg.

Hereinafter, this constituent element will be described in detail, but the present invention is not limited to the scope described below at all as long as it is not beyond the gist of the present invention.

[Fibrous Base Material Made of Ultrafine Fibers]

First, the sheet material of the present invention has a fibrous base material made of ultrafine fibers.

Examples of the resin that can be used for the ultrafine fiber include a polyester-based resin and a polyamide-based resin from the viewpoint of excellent durability, particularly, mechanical strength, heat resistance, and chemical resistance.

In the present invention, when a polyester-based resin is used as the resin used for the ultrafine fiber, polyethylene terephthalate, polybutylene terephthalate, polytrimethylene terephthalate, and copolymers thereof can be used. In addition, the polyester-based resin can be obtained from, for example, dicarboxylic acid and/or an ester-forming derivative thereof and a diol.

Examples of the dicarboxylic acid and/or the ester-forming derivative thereof used for the polyester-based resin include terephthalic acid, isophthalic acid, 2,6-naphthalenedicarboxylic acid, diphenyl-4,4'-dicarboxylic acid, and an ester-forming derivative thereof. Note that the ester-forming derivative referred in the present invention is lower alkyl ester of dicarboxylic acid, acid anhydride, acyl chloride, and the like. Specifically, methyl ester, ethyl ester, hydroxyethyl ester, and the like are preferably used. Examples of the dicarboxylic acid and/or ester-forming derivative thereof according to a preferable aspect of the invention include terephthalic acid and/or a dimethyl ester thereof.

Examples of the diol used in the polyester-based resin include ethylene glycol, 1,3-propanediol, 1,4-butanediol, and cyclohexanedimethanol. Among them, ethylene glycol is preferably used.

In the present invention, when a polyamide-based resin is used as the resin used for the ultrafine fiber, polyamide 6, polyamide 66, polyamide 56, polyamide 610, polyamide 11, polyamide 12, copolymerized polyamide, and the like can be used.

The resin used for the ultrafine fibers may contain inorganic particles such as titanium oxide particles, a lubricant, a pigment, a thermal stabilizer, an ultraviolet absorber, a conductive agent, a heat storage agent, an antimicrobial agent and the like according to various purposes as long as the object of the present invention is achieved.

Furthermore, the resin used for the ultrafine fiber of the present invention more preferably contains a component derived from biomass resources.

As the component derived from biomass resources, when a polyester-based resin is used as a resin used for ultrafine fibers, a component derived from biomass resources may be used as dicarboxylic acid or an ester-forming derivative thereof, which is a constituent of the polyester-based resin, or a component derived from biomass resources may be used as diol. From the viewpoint of reducing the environmental load, it is preferable to use a component derived from biomass resources for both the dicarboxylic acid or the ester-forming derivative thereof and the diol.

As the component derived from biomass resources, polyamide 56, polyamide 610, and polyamide 11 are preferably used from the viewpoint of economically advantageously obtaining a raw material derived from biomass resources and the physical properties of fibers when a polyamide resin is used as a resin used for the ultrafine fibers.

As the cross-sectional shape of the ultrafine fiber, either a round cross section or a modified cross section can be adopted. Specific examples of the modified cross section include an elliptical shape, a flat shape, a polygonal shape such as a triangular shape, a fan-like shape, and a cross shape.

In the present invention, the average single-fiber diameter of the ultrafine fibers is 0.1 μm or more and 10 μm or less. When the average single-fiber diameter of the ultrafine fibers is 10 μm or less, preferably 7 μm or less, and more preferably 5 μm or less, it is possible to cause the sheet material to be more soft. In a case where the sheet material has a nap, the nap quality can be improved. Meanwhile, when the average single-fiber diameter of the ultrafine fibers is 0.1 μm or more, preferably 0.3 μm or more, and more preferably 0.7 μm or more, it is possible to obtain a sheet material superior in color developability after dyeing. Further, in a case where the sheet material has a nap, when napped by buffing, bundled ultrafine fibers can be easy to disperse and handle.

As used herein, the average single-fiber diameter can be measured by the following protocol. That is:

(1) A cross section of the obtained sheet material cut in the thickness direction is observed with a scanning electron microscope (SEM).

(2) The fiber diameters of any 50 ultrafine fibers in the observation plane with respect to 3 sites on each ultrafine fiber cross section are measured. Provided that in the case of utilizing ultrafine fibers with a modified cross section, the cross-section area of single fiber is measured and the diameter of a circle corresponding to the cross-section area is calculated using the following equation. The obtained diameter is defined as the single fiber diameter of the single fiber.

$$\text{Single fiber diameter}(\mu m)=(4\times(\text{cross-section area } (\mu m^2) \text{ of single fiber})/\pi)^{1/2}$$

(3) The total of the diameters obtained at 150 points is averaged and the arithmetic mean value (μm) is rounded off to the first decimal place.

The fibrous base material used in the present invention is made of the ultrafine fiber. In this regard, it is allowed that the ultrafine fibers of different raw materials are mixed in the fibrous base material.

As a specific form of the above fibrous base material, it is possible to use a nonwoven fabric in which the above ultrafine fibers are interlaced or a nonwoven fabric in which fiber bundles of ultrafine fibers are interlaced. Among them, a nonwoven fabric in which fiber bundles of ultrafine fibers are interlaced is preferably used, from the viewpoints of the strength and texture of a sheet material. From the viewpoints of flexibility and texture, it is particularly preferable to use a nonwoven fabric in which ultrafine fibers constituting fiber bundles of ultrafine fibers are appropriately spaced from one another to form spaces. As described above, the nonwoven fabric, in which fiber bundles of ultrafine fibers are interlaced, may be obtained by, for example, beforehand interlacing ultrafine fiber-generating fibers and then generating ultrafine fibers. Further, the nonwoven fabric, in which ultrafine fibers constituting fiber bundles of the ultrafine fibers are appropriately spaced from one another to form spaces, can be obtained by, for example, using sea-island composite fibers in which a sea component may be removed to make a space between island components.

The nonwoven fabric may be either a short fiber nonwoven fabric or a long fiber nonwoven fabric. From the viewpoint of the texture and quality of the sheet material, the short fiber nonwoven fabric is more preferably used.

The fiber length of the short fibers in the case of using the short fiber nonwoven fabric is preferably in a range of 25 mm or more and 90 mm or less. When the fiber length is 25 mm or longer, more preferably 35 mm or longer, and still more preferably 40 mm or longer, a sheet material with excellent wear resistance can be easily obtained by interlacing. Further, the fiber length is set to 90 mm or less, more preferably 80 mm or less, and still more preferably 70 mm or less, so that it is possible to obtain a sheet material having more excellent texture and quality.

In the present invention, when a nonwoven fabric is used as the fibrous base material, a woven fabric or a knitted fabric may be inserted into or laminated on the nonwoven fabric, or the nonwoven fabric may be lined with a woven fabric or a knitted fabric, for the purpose of improving strength or the like. The average single-fiber diameter of the fibers constituting the woven fabric and the knitted fabric is more preferably 0.3 μm or more and 10 μm or less, because damage during needle punching can be reduced and the strength can be maintained.

Examples of the fibers constituting the woven fabric and the knitted fabric include synthetic fibers made of a thermoplastic resin represented by polyesters such as "polyethylene terephthalate, polybutylene terephthalate, polytrimethylene terephthalate, and polylactic acid", polyamides such as "polyamide 6, polyamide 66, polyamide 56, polyamide 610, polyamide 11, polyamide 12, and copolymerized polyamide", regenerated fibers such as cellulose-based polymers, and natural fibers such as cotton and hemp.

In the present invention, as means for obtaining a fibrous base material made of ultrafine fibers, it is preferable to adopt a method for preparing a fibrous base material using ultrafine fiber-generating fibers and generating the ultrafine fibers by means described later.

As the ultrafine fiber-generating fibers, it is preferable to use a sea-island composite fiber in which two components (two or three components when the island fiber is a core-sheath composite fiber) of thermoplastic resins having different solvent solubility are used as a sea component and an island component, and the sea component is dissolved and removed using a solvent or the like to form an island component as an ultrafine fiber, from the viewpoint of the texture and surface appearance of the sheet material, because appropriate spaces can be added between the island components, that is, between the ultrafine fibers inside the fiber bundle when the sea component is removed.

As the sea-island composite fiber, a method for using a spinneret for a sea-island composite and using a polymer mutual array in which two components of a sea component and an island component (three components when the island fiber is a core-sheath composite fiber) are arranged and spun is preferable from the viewpoint of obtaining ultrafine fibers having a uniform individual fiber fineness.

As the sea component of the sea-island composite fiber, for example, a copolymerized polyester obtained by copolymerizing polyethylene, polypropylene, polystyrene, sodium sulfoisophthalic acid, polyethylene glycol or the like, and polylactic acid can be used, but polystyrene or copolymerized polyester is preferably used from the viewpoint of yarn making property, easy elutability, and the like.

The sea component is preferably dissolved and removed after the first elastomer precursor impregnation step.

It is preferable that the mass ratio between the sea component and the island component in the sea-island composite fibers used in the present invention be in a range of sea component:island component=10:90 to 80:20. When the mass ratio of the sea component is 10% by mass or more, the island component tends to be made sufficiently ultrafine. When the mass ratio of the sea component is 80 mass or less, the proportion of the eluted component is small and the productivity is thus improved. The mass ratio between the sea component and the island component is more preferably in a range of the sea component:the island component=20:80 to 70:30.

In addition, the fibrous base material made of ultrafine fiber-generating fibers preferably takes the form of a nonwoven fabric, and can be used as a so-called short fiber nonwoven fabric or a long fiber nonwoven fabric. However, when the fibrous base material is a short fiber nonwoven fabric, the number of fibers facing the thickness direction of the sheet material is larger than that of the long fiber nonwoven fabric, and a high degree of dense feeling can be obtained on the surface of the sheet material at the time of nap raising, which is preferable.

If a short fiber nonwoven fabric is used as a fibrous base material made the ultrafine fiber-generating fibers, first, it is preferable for the obtained ultrafine fiber-generating fibers to be crimped and then cut to a required length to provide raw stock. Generally known methods may be used for the crimping and cutting steps.

Then, the obtained raw stock is processed by, for example, a cross lapper to produce a fiber web, which is then subjected to fiber interlacing treatment to provide short fiber nonwoven fabric. As a method for interlacing fiber webs to obtain a short fiber nonwoven fabric, needle punching, water jet punching, or the like can be used.

Furthermore, the obtained short fiber nonwoven fabric and woven fabric are stacked and interlaced and integrated. For the interlacing and integration of the short fiber nonwoven fabric and the woven fabric, the woven fabric is stacked on one surface or both surfaces of the short fiber nonwoven fabric, or the woven fabric is sandwiched between a plurality of short fiber nonwoven fabric webs, and then the fibers of the short fiber nonwoven fabric and the woven fabric can be interlaced by needle punching, water jet punching, or the like.

The apparent density of the short fiber nonwoven fabric made of composite fibers (ultrafine fiber-generating fibers) after needle punching or water jet punching is preferably 0.15 g/cm$^3$ or more and 0.45 g/cm$^3$ or less. Preferably, when the apparent density is 0.15 g/cm$^3$ or higher, the sheet material should have sufficient shape stability and dimension stability. In addition, preferably, when the apparent density is 0.45 g/cm$^3$ or lower, a sufficient space can be kept such that the elastomer is formed.

From the viewpoint of denseness, the short fiber nonwoven fabric thus obtained may be contracted and further highly densified by dry heat or wet heat or by both in a preferable embodiment. Further, the short fiber nonwoven fabric may be compressed in the thickness direction by calendaring or the like.

[Elastomer]

Next, the sheet material of the present invention has an elastomer. This elastomer is formed by a reaction between an elastomer precursor and a crosslinker.

Hereinafter, this detail will be further described.

(1) Elastomer Precursor

First, the elastomer precursor according to the present invention has a hydrophilic group. In the present invention, the phrase "having a hydrophilic group" refers to "having a group having active hydrogen". Specific examples of the group having active hydrogen include a hydroxyl group, a carboxyl group, a sulfonic acid group, and an amino group.

Examples of the elastomer precursor include water-dispersed silicone resins, water-dispersed acrylic resins, water-dispersed urethane resins, and copolymers thereof. Among them, water-dispersed polyurethane resins are preferably used from the viewpoint of texture. In particular, a water-dispersed polyurethane resin prepared by reacting polymeric polyol described below, organic diisocyanate, and an active hydrogen component-containing compound having a hydrophilic group to form a hydrophilic prepolymer, and then adding and reacting a chain extender is more preferably used. Hereinafter, these will be described in detail.

(a) Polymeric Polyol

Examples of the polymeric polyol preferably used in the present invention include polyether-based polyol, polyester-based polyol, and polycarbonate-based polyol.

Examples of the polyether-based polyol include polyols obtained by adding and polymerizing a monomer such as ethylene oxide, propylene oxide, butylene oxide, styrene oxide, tetrahydrofuran, epichlorohydrin, or cyclohexylene using a polyhydric alcohol or a polyamine as an initiator, and polyols obtained by ring-opening polymerization of the monomer using a protic acid, a Lewis acid, a cationic catalyst, or the like as a catalyst. Specific examples thereof include polyethylene glycol, polypropylene glycol, polytetramethylene glycol, and copolymerized polyol obtained by combining these glycols.

Next, examples of the polyester-based polyol include polyester polyols obtained by condensing various low-molecular-weight polyols with a polybasic acid, and polyols obtained by ring-opening polymerization of lactones.

Examples of low-molecular-weight polyols used for polyester-based polyols include one or more selected from linear alkylene glycols such as "ethylene glycol, 1,3-propylene glycol, 1,4-butanediol, 1,5-pentanediol, 1,6-hexanediol, 1,7-heptanediol, 1,8-octanediol, 1,9-nonanediol, and 1,10-decanediol"; branched alkylene glycols such as "neopentyl glycol, 3-methyl-1,5-pentanediol, 2,4-diethyl-1,5-pentanediol, and 2-methyl-1,8-octanediol"; alicyclic diols such as 1,4-cyclohexanediol; and aromatic dihydric alcohols such as 1,4-bis(β-hydroxyethoxy)benzene. Adducts obtained by adding various alkylene oxides to bisphenol A can also be used as low-molecular-weight polyols.

Examples of the polybasic acid used for polyester-based polyol include one or more selected from the group consisting of succinic acid, maleic acid, adipic acid, glutaric acid, pimelic acid, suberic acid, azelaic acid, sebacic acid, dodecanedicarboxylic acid, phthalic acid, isophthalic acid, terephthalic acid, and hexahydroisophthalic acid.

Further, examples of the polycarbonate-based polyol include compounds obtained by reacting polyol with a carbonate compound such as polyol and dialkyl carbonate or polyol and diaryl carbonate.

As the polyol used for the polycarbonate-based polyol, a low-molecular-weight polyol used for the polyester-based polyol can be used. Meanwhile, as the dialkyl carbonate, dimethyl carbonate, diethyl carbonate, or the like can be used, and as the diaryl carbonate, diphenyl carbonate or the like can be listed.

The number average molecular weight of the polymeric polyol preferably used in the present invention is preferably 500 or more and 5,000 or less. The number average molecular weight of the polymeric polyol is set to 500 or more, and more preferably 1500 or more, so that it is possible to easily prevent the texture of the sheet material from becoming hard. Further, the number average molecular weight is set to 5,000 or less, and more preferably 4,000 or less, so that it is possible to easily maintain the strength of the polyurethane as a binder.

(b) Organic Diisocyanate

Examples of the organic diisocyanate preferably used in the present invention include a C6-20 aromatic diisocyanate (excluding carbon atoms in an isocyanate group; the same applies to the following), a C2-18 aliphatic diisocyanate, a C4-15 alicyclic diisocyanate, a C8-15 aroaliphatic diisocyanate, a modified product of these diisocyanates (for example, a carbodiimide-modified product, a urethane-modified product, a uretdione-modified product), or a mixture of two or more kinds thereof.

Specific examples of the C6-20 aromatic diisocyanate include 1,3- and/or 1,4-phenylene diisocyanate, 2,4- and/or 2,6-tolylene diisocyanate, 2,4'- and/or 4,4'-diphenylmethane diisocyanate (hereinafter, may be abbreviated as MDI), 4,4'-diisocyanatobiphenyl, 3,3'-dimethyl-4,4'-diisocyanatobiphenyl, 3,3'-dimethyl-4,4'-diisocyanatodiphenylmethane, and 1,5-naphthylene diisocyanate.

Specific examples of the C2-18 aliphatic diisocyanate include ethylene diisocyanate, tetramethylene diisocyanate, hexamethylene diisocyanate, dodecamethylene diisocyanate, 2,2,4-trimethylhexamethylene diisocyanate, lysine diisocyanate, 2,6-diisocyanatomethylcaproate, bis(2-isocyanatoethyl)carbonate, and 2-isocyanatoethyl-2,6-diisocyanatohexaate.

Specific examples of the C4-15 alicyclic diisocyanate include isophorone diisocyanate, dicyclohexylmethane-4,4'-diisocyanate, cyclohexylene diisocyanate, methylcyclohexylene diisocyanate, bis(2-isocyanatoethyl)-4-cyclohexylene-1,2-dicarboxylate, and 2,5- and/or 2,6-norbornane diisocyanate.

Specific examples of the C8-15 aroaliphatic diisocyanate include m- and/or p-xylylene diisocyanate, and α,α,α',α'-tetramethylxylylene diisocyanate.

Among them, more preferable organic diisocyanate is alicyclic diisocyanate having 4 or more and 15 or less carbon atoms. A particularly preferable organic diisocyanate is dicyclohexylmethane-4,4'-diisocyanate (hereinafter, may be abbreviated as hydrogenated MDI).

(c) Active Hydrogen Component-Containing Compound Having Hydrophilic Group

Examples of the active hydrogen component-containing compound having a hydrophilic group preferably used in the present invention include a compound containing a nonionic group and/or an anionic group and/or a cationic group and active hydrogen. The active hydrogen component-containing compound can also be used in the form of salt neutralized with a neutralizer. By using this active hydrogen component-containing compound having a hydrophilic group, the stability of the aqueous dispersion used in the method for producing a sheet material can be enhanced.

Examples of the compound having a nonionic group and active hydrogen include compounds containing two or more active hydrogen components or two or more isocyanate groups and having a polyoxyethylene glycol group with a molecular weight of 250 to 9,000 or the like in a side chain, and triols such as trimethylol propane and trimethylol butane.

Examples of the compound having an anionic group and active hydrogen include carboxyl group-containing compounds such as 2,2-dimethylol propionic acid, 2,2-dimethylol butanoic acid and 2,2-dimethylol valeric acid and derivatives thereof, sulfonic group-containing compounds such as 1,3-phenylenediamine-4,6-disulfonic acid and 3-(2,3-dihydroxypropoxy)-1-propanesulfonic acid and derivatives thereof, and salts obtained by neutralizing these compounds with a neutralizer.

Examples of the compound containing a cationic group and active hydrogen include tertiary amino group-containing compounds such as 3-dimethylaminopropanol, N-methyldiethanolamine, and N-propyldiethanolamine, and derivatives thereof.

(d) Chain Extender

Examples of the chain extender preferably used in the present invention include water, a low-molecular-weight diol such as "ethylene glycol, propylene glycol, 1,3-butylene glycol, 1,4-butanediol, 1,6-hexanediol, diethylene glycol, or neopentyl glycol", an alicyclic diol such as "1,4-bis(hydroxymethyl)cyclohexane", an aromatic diol such as "1,4-bis(hydroxyethyl)benzene", an aliphatic diamine such as "ethylenediamine", an alicyclic diamine such as "isophoronediamine", an aromatic diamine such as "4-4-diaminodiphenylmethane", an aroaliphatic diamine such as "xylenediamine", an alkanolamine such as "ethanolamine", hydrazine, a dihydrazide such as "adipic acid dihydrazide", and a mixture of two or more kinds thereof.

Among them, more preferable chain extenders are water, low molecular weight diols, and aromatic diamines, and more preferable examples thereof include water, ethylene glycol, 1,4-butanediol, 4,4'-diaminodiphenylmethane, and a mixture of two or more kinds thereof.

(e) Structure of Water-Dispersed Polyurethane Resin

As described above, the water-dispersed polyurethane resin preferably used in the present invention is prepared by reacting polymeric polyol described above, organic diisocyanate, and an active hydrogen component-containing compound having a hydrophilic group to form a hydrophilic prepolymer, and then adding and reacting a chain extender is more preferably used.

(f) Structure of Elastomer Precursor

The elastomer precursor according to the present invention preferably contains polyether diol and/or polycarbonate diol as a constituent. In the present specification, the phrase "A contains B as a constituent" refers to "B is contained as a monomer component or an oligomer component constituting A".

When the elastomer precursor according to the present invention contains the polyether diol as a constituent, the elastomer precursor has a high degree of freedom of the ether bond, so that the elastomer has a low glass transition temperature and weak cohesive force, and thus has excellent flexibility. On the other hand, by containing polycarbonate diol as a constituent, an elastomer excellent in water resistance, heat resistance, and weather resistance can be obtained due to the high cohesive force of the carbonate group.

The number average molecular weight of the elastomer precursor used in the present invention is preferably 20,000 or more and 500,000 or less. When it is 20,000 or more, and more preferably 30,000 or more, the strength of the elastomer can be increased. On the other hand, when the content is 500,000 or less, and more preferably 150,000 or less, the viscosity stability can be enhanced, and the workability can be improved.

The number average molecular weight of the elastomer precursor can be determined by gel permeation chromatography (GPC), and is measured under, for example, the following conditions:

Instrument: HLC-8220, manufactured by Tosoh Corporation

Column: TOSOH TSKgel α-M

Solvent: N,N-dimethylformamide (DMF)

Temperature: 40° C.

Calibration: polystyrene (2) Crosslinker

Subsequently, as the crosslinker according to the present invention, a polymer compound having a carbodiimide group, an isocyanate group, an oxazoline group, an epoxy group, a melamine resin, a silanol group, or the like can be used.

In particular, when a water-dispersed polyurethane resin is used as the elastomer precursor, it is preferable to form an N-acylurea bond and/or an isourea bond using a carbodiimide crosslinker containing a carbodiimide group and a blocked isocyanate crosslinker in which an isocyanate group is generated by heating. As a result, a three-dimensional crosslinked structure by N-acylurea bond and/or isourea bond, which is superior in physical properties, such as light resistance, heat resistance and wear resistance, and flexibility, can be added into the molecule of the elastomer in the sheet material, and physical properties such as wear resistance can be dramatically improved while maintaining the flexibility of the sheet material.

(3) Elastomer

The elastomer of the sheet material of the present invention is formed by reacting the elastomer precursor with a crosslinker. By this reaction, the elastomer of the present invention has a hydrophilic group derived from the elastomer precursor and further has an N-acylurea bond and/or an isourea bond. By having these bonds, as described above, physical properties such as wear resistance can be dramatically improved while maintaining the flexibility of the sheet material.

The presence of the N-acylurea group or the isourea group in the elastomer can be analyzed by performing, for example, mapping treatment (examples of the analytical instrument include "TOF. SIMS 5" manufactured by ION-TOF Corporation) such as time-of-flight secondary ion mass spectrometry (TOF-SIMS analysis) or infrared spectroscopic analysis (examples of the analytical instrument include "FT/IR 4000 series" manufactured by JASCO Corporation) on the cross section of the sheet material.

The elastomer according to the present invention preferably contains polyether diol and/or polycarbonate diol as a constituent.

When the elastomer according to the present invention contains the polyether diol as a constituent, the elastomer precursor has a high degree of freedom of the ether bond, so that the elastomer has a low glass transition temperature and weak cohesive force, and thus has excellent flexibility. On the other hand, by containing polycarbonate diol as a constituent, an elastomer excellent in water resistance, heat resistance, and weather resistance can be obtained due to the high cohesive force of the carbonate group.

In the sheet material of the present invention, the elastomer preferably includes an elastomer A containing polyether diol as a constituent, and an elastomer B containing polycarbonate diol as a constituent. Both the elastomer A containing polyether diol as a constituent superior in flexibility and the elastomer B containing polycarbonate diol as a constituent superior in durability against external stimuli such as light and heat are contained in the sheet material, whereby a sheet material superior in flexibility and durability is easily obtained.

The elastomer having a hydrophilic group used in the present invention appropriately retains fibers in the sheet material, and is preferably present in the fibrous base material from the viewpoint of providing at least one nap surface of the sheet material, which is a preferable embodiment.

[Sheet Material]

In the sheet material of the present invention, the longitudinal stiffness, in accordance with method A (45° cantilever method) in the text of "8.21 Stiffness" of JIS L 1096: 2010 "Testing Methods for Woven and Knitted Fabrics", is 40 mm or more and 140 mm or less. When the stiffness is within the above range, a sheet material having moderate flexibility and repulsive feeling can be easily obtained. By setting the stiffness to 50 mm or more, more preferably 55 mm or more, a sheet material having more repulsive can be obtained. On the other hand, by setting the stiffness to 120 mm or less, more preferably 110 mm or less, a sheet material having more flexibility can be obtained.

The "longitudinal direction" in the sheet material of the present invention refers to a direction in which nap raising is performed on the sheet material in a manufacturing process of the sheet material. As a method for searching the direction in which the nap raising is performed, it is possible to appropriately adopt a method according to the constituents of the sheet material, such as visual check when tracing with a finger or SEM photographing. That is, the direction in which the napped fibers can be laid or raised when being traced with a finger is the longitudinal direction. In addition, when the surface of the sheet material traced with the finger is photographed by SEM, the direction in which the direction of the laid napped fibers is the largest is the longitudinal direction. On the other hand, a lateral direction in the sheet material of the present invention refers to a direction perpendicular to the longitudinal direction in the sheet material plane.

In addition, in the sheet material of the present invention, after immersion for 24 hours in N,N-dimethylformamide, the following are obtained in wear testing using a pressing load of 12.0 kPa and 20,000 friction cycles in accordance with method E (Martindale method) in the text of "8.19 Wear Strength and Friction Discoloration" of JIS L 1096: 2010 "Testing Methods for Woven and Knitted Fabrics": a grade of at least 4 and a wear loss of not more than 25 mg. When the surface appearance series and the wear loss after immersion in N,N-dimethylformamide for 24 hours are within these ranges, reduction in the molecular weight of the elastomer can be suppressed and the appearance of the sheet material can be maintained even when the elastomer is used for a long period of time in a severe environment exposed to an organic solvent, an acid, an alkaline solution, or sunlight. The wear loss is preferably 23 mg or less, and more preferably 20 mg or less because deterioration of the appearance of the sheet material can be suppressed.

The sheet material of the present invention preferably has a wet tensile strength of 75% or more of a dry tensile strength of the sheet material. When the wet tensile strength is within this range, deterioration of physical properties at the time of dyeing and post-processing can be suppressed, and the durability of the product can be further enhanced. When the wet tensile strength is more preferably 77% or more, and still more preferably 80% or more, deterioration of the sheet material can be further suppressed.

The sheet material of the present invention preferably has a wet tensile strength and elongation is 100% or more of a dry tensile elongation of the sheet material. When the wet tensile elongation is within this range, deterioration of physical properties at the time of dyeing and post-processing can be suppressed, and the durability of the product can be further enhanced. When the wet tensile elongation is more preferably 105% or more, and still more preferably 110% or more, deterioration of the sheet material can be further suppressed.

In the present invention, the tensile strength and the tensile elongation of a sheet material when it is dry or wet are values measured and calculated in accordance with "6.3 Tensile strength and elongation rate (ISO method)" in "Test methods for nonwovens" specified in JIS L 1913: 2010.

(A) at the Time of Drying (1) A sample is allowed to stand for 1 hour or longer under conditions of a room temperature of 18° C. or higher and 28° C. or lower and a humidity of 35% or more and 75% or less.

(2) From the sheet material, 5 longitudinal test pieces each having a width of 20 mm and a length of 300 mm (among them, the grip interval is 200 mm) are taken.

(3) A test piece is attached to a constant-speed extension-type tensile tester at a grip interval of 200 mm under an initial load (a load in a state where the test piece is pulled by hand to such an extent that no sagging occurs).

(4) A load is applied at a tensile speed of 100 mm/min until the test piece is cut.

(5) A strength (N) of the test piece at a maximum load is measured up to 0.1 N units, and an elongation at the maximum load is measured up to 1 mm. The elongation rate is determined from the elongation.

(6) The tensile strength is measured in the same manner for each test piece, and an arithmetic average value of the values obtained by dividing the strength (N) at the maximum load by the test piece width (cm) is taken as a tensile strength (N/cm), and an arithmetic average value of the elongation rate is taken as a tensile elongation (%).

(B) At the Time of Wetting (1) A sample is allowed to stand for 1 hour or longer under conditions of a room temperature of 18° C. or higher and 28° C. or lower and a humidity of 35% or more and 75% or less.

(2) A sheet material is immersed in water at room temperature for 10 minutes.

(3) From the sheet material, 5 longitudinal test pieces each having a width of 20 mm and a length of 300 mm (among them, the grip interval is 200 mm) are taken.

(4) A test piece is attached to a constant-speed extension-type tensile tester at a grip interval of 200 mm under an initial load (a load in a state where the test piece is pulled by hand to such an extent that no sagging occurs).

(5) A load is applied at a tensile speed of 100 mm/min until the test piece is cut.

(6) A strength (N) of the test piece at a maximum load is measured up to 0.1 N units, and an elongation at the maximum load is measured up to 1 mm. The elongation rate is determined from the elongation.

(7) The tensile strength is measured in the same manner for each test piece, and an arithmetic average value of the values obtained by dividing the strength (N) at the maximum load by the test piece width (cm) is taken as a tensile strength (N/cm), and an arithmetic average value of the elongation rate is taken as a tensile elongation (%).

In addition, the wet tensile strength retention and the wet tensile elongation retention are defined as follows.

Wet tensile strength retention (%)=Wet tensile strength (N/cm)/dry tensile strength (N/cm)×100

Wet tensile elongation retention (%)=Wet tensile elongation (%)/dry tensile elongation (%)×100.

The sheet material of the present invention preferably has an L value retention of 90% or more and 100% or less when the nap raising surface of the sheet material is placed on a hot plate heated to 150° C. and pressed at a pressing load of 2.5 kPa for 10 seconds (hereinafter, sometimes simply abbreviated as L value retention). In particular, when the L value retention is 90% or more, more preferably 92% or more, and still more preferably 95% or more, the sheet material has high heat resistance.

In the present invention, the "nap raising surface of the sheet material" refers to a surface obtained by nap raising the sheet material. In addition, the L value is an L value defined by the International Commission on Illumination (CIE). The L value retention in the present invention is an index indicating that a rate of change in brightness under heating and pressing conditions is small, that is, to what extent a sheet material having a bright color before heating and pressing does not become dark after heating and pressing.

In the present invention, the L value retention refers to a value measured and calculated by the following procedure.

(1) The sheet material is cut, and the L value of the cut test piece is measured using a color difference meter (for example, "CR-410", manufactured by Konica Minolta, Inc.).

(2) The test piece is placed on a hot plate (for example, "CHP-250 DN", manufactured by AS ONE Corporation) heated to 150° C. with the nap raising surface of the test piece facing down.

(3) An indenter adjusted to have a pressing load of 2.5 kPa is placed on the test piece, and held for 10 seconds.

(4) The indenter on the test piece is removed, and the L value of the nap raising surface of the test piece is measured with the color difference meter.

(5) The L value retention is calculated by the following equation.

$L$ value retention (%)=($L$ value measured by(1))/($L$ value measured by(4))×100

In the sheet material of the present invention, further, in a washing test according to the ISO 6330 C4N method, when the washing test of one sheet of the sheet material is performed, and fiber fragments attached to a collecting bag attached to a drain hose is collected using a membrane filter after the test, the amount of the fiber fragment can be set to 10.0 (mg/sheet material 100 $cm^2$) or less. In particular, when the amount of the fiber fragment is 8.0 (mg/100 $cm^2$ of the sheet material) or less, more preferably 6.0 (mg/100 $cm^2$ of the sheet material) or less, and still more preferably 5.0 (mg/100 $cm^2$ of the sheet material) or less, the sheet material is less likely to fall off during washing, and thus the environmental load is small.

In the present invention, in a washing test according to the ISO 6330 C4N method, when the washing test of one sheet of the sheet material is performed, and fiber fragments attached to a collecting bag attached to a drain hose is collected using a membrane filter after the test, the amount of the fiber fragment is measured and calculated by the following procedure. First, washing is performed according to ISO 6330 C4N without putting an object to be washed or a detergent in a washing machine and the washing machine is cleaned. Next, in a state where a collection bag manufactured using "nylon screen" NY10-HC (manufactured by FLON INDUSTRY) with a sieve opening of 10 μm is attached to a drain hose of the washing machine, one sheet material to be evaluated is put in the washing machine, and the washing is performed according to the ISO 6330 C4N method. However, a detergent and a loading fabric are not used. After the washing, suction filtration is performed using a polycarbonate membrane (K040A047A, manufactured by Advantec Toyo Kaisha, Ltd.) in which a weight of the fiber fragments attached to the "nylon screen" is measured in advance. The polycarbonate membrane and the fiber fragments after filtration are dried at 105° C. for 1 hour, the weight is measured, and a difference from the weight before filtration is taken as the amount of fiber fragments.

In order to set the stiffness, the wear series and the weight reduction after the N,N-dimethylformamide treatment, the wet tensile strength, the wet tensile elongation, the L-value retention, and the amount of fiber fragments during washing within the above ranges, for example, a sheet material is produced through a first elastomer precursor impregnation step, an ultrafine fiber generating step, and a second elastomer precursor impregnation step described later. By undergoing the ultrafine fiber generating step after impregnation with the first elastomer precursor, the ultrafine fiber can be formed in a gap between the ultrafine fiber and the elastomer, and a soft texture is easily obtained. By undergoing the second elastomer precursor impregnation step after the ultrafine fiber is generated, the elastomer added first can be reinforced, and chemical resistance and dyeing resistance can be easily improved. Furthermore, by setting the thermal coagulation temperature of the aqueous dispersion to the range described later, uneven distribution (migration) of the polyurethane to the surface of the sheet material due to moisture evaporation can be suppressed, deterioration of the polyurethane due to hot pressing can be suppressed, and the L value retention can be increased.

The sheet material of the present invention can be suitably used as interior materials having a very elegant appearance, such as surface materials of furniture, chairs, walls, seats in vehicles including automobiles, trains, and aircrafts, ceiling, and interior decoration; clothing materials, such as shirts, jackets, upper and trim and the like of shoes including casual shoes, sports shoes, men's shoes and ladies' shoes, bags, belts, wallets, and a part of them; and industrial materials such as wiping cloth, abrasive cloth, and CD curtains.

[Method for Producing Sheet Material]

A method for producing a sheet material of the present invention includes the following steps (1) to (3) in this order.

(1) A first elastomer precursor impregnation step of forming an elastomer by impregnating a fibrous base material made of ultrafine fiber-generating fibers with an aqueous dispersion containing an elastomer precursor having a hydrophilic group, a monovalent cation-containing inorganic salt, and a crosslinker, and then subjecting the fibrous base material impregnated with the aqueous dispersion to a heat drying treatment at a temperature of 100° C. or higher and 180° C. or lower, wherein a content of the monovalent cation-containing inorganic salt in the aqueous dispersion is 10 parts by mass or more and 100 parts by mass or less with respect to 100 parts by mass of the elastomer precursor.

(2) An ultrafine fiber generating step of generating ultrafine fibers from the ultrafine fiber-generating fibers to form a ultrafine fibrous base material made of the ultrafine fibers.

(3) A second elastomer precursor impregnation step of further forming an elastomer by impregnating a fibrous base material made of the ultrafine fibers with an aqueous dispersion containing an elastomer precursor having a hydrophilic group, a monovalent cation-containing inorganic salt, and a crosslinker, and then subjecting the fibrous base material impregnated with the aqueous dispersion to a heat drying treatment at a temperature of 100° C. or higher and 180° C. or lower, wherein a content of the monovalent cation-containing inorganic salt in the aqueous dispersion is 10 parts by mass or more and 100 parts by mass or less with respect to 100 parts by mass of the elastomer precursor.

Hereinafter, these will be described in detail in order.

(1) First Elastomer Precursor Impregnation Step

In this step, an elastomer is formed by impregnating a fibrous base material made of ultrafine fiber-generating fibers with an aqueous dispersion containing an elastomer precursor having a hydrophilic group, a monovalent cation-containing inorganic salt, and a crosslinker, and then subjecting the fibrous base material impregnated with the aqueous dispersion to a heat drying treatment at a temperature of 100° C. or higher and 180° C. or lower.

(1-a) Aqueous Dispersion

First, the aqueous dispersion used in this step contains the elastomer precursor having a hydrophilic group, a monovalent cation-containing inorganic salt, and a crosslinker.

The concentration of the elastomer precursor in the aqueous dispersion is preferably 5% by mass or more and 50% by mass or less in the aqueous dispersion. By setting the concentration of the elastomer precursor in the aqueous dispersion to 5% by mass or more, and more preferably 10% by mass or more, cohesiveness is improved, the elastomer is aggregated in a large mass, and good wear resistance is obtained. On the other hand, when the concentration is 50% by mass or less, and more preferably 40% by mass or less, the elastomer can be uniformly added to the fibrous base material.

Next, the aqueous dispersion contains a monovalent cation-containing inorganic salt. The monovalent cation-containing inorganic salt is contained, thereby making it possible to impart thermosensitive coagulability to the aqueous dispersion. In the present invention, the thermosensitive coagulability refers to a property of decreasing fluidity of the aqueous dispersion and coagulating the aqueous dispersion after a certain temperature (hereinafter, referred to as thermal coagulation temperature) is reached at the time of heating the aqueous dispersion.

The aqueous dispersion has a thermal coagulation temperature of preferably 55° C. or higher to 80° C. or lower. By setting a dry thermal coagulation temperature to 55° C. or higher, and more preferably 60° C. or higher, the stability of the aqueous dispersion at the time of storage is improved, and it is possible to suppress the adhesion of the elastomer to the production facility at the time of operation. On the other hand, by setting the dry thermal coagulation temperature to 80° C. or lower, and more preferably 70° C. or lower, it is possible to suppress the migration phenomenon in which the elastomer migrates to the surface of the fibrous base material along with evaporation of moisture, and further, it is possible to form a structure in which the elastomer does not bind the fiber strongly as the coagulation of the elastomer proceeds before evaporation of moisture from the fibrous base material, and it is possible to achieve good flexibility and repulsive feeling.

This monovalent cation-containing inorganic salt is preferably sodium chloride and/or sodium sulfate. In the known method, an inorganic salt having a divalent cation such as magnesium sulfate or calcium chloride has been suitably used as a thermosensitive coagulant. However, even when these inorganic salts are added in a small amount, the stability of the aqueous dispersion is greatly affected, so that it is difficult to strictly control the thermosensitive gelation temperature by adjusting the amount of the inorganic salts added depending on the type of the elastomer precursor, and there is a problem in that gelation may occur at the time of adjusting or storing the aqueous dispersion. Meanwhile, the monovalent cation-containing inorganic salt having a small ionic valence has a relatively small influence on the stability of the aqueous dispersion. Thus, the additive amount is adjusted, as a result of which the thermal coagulation temperature of the aqueous dispersion can be strictly controlled while ensuring the stability of the aqueous dispersion.

In this aqueous dispersion, the monovalent cation-containing inorganic salt is contained in an amount of 10 parts by mass or more and 100 parts by mass or less with respect to 100 parts by mass of the elastomer precursor in the aqueous dispersion. When the amount to be contained is 10 parts by mass or more, ions present in a large amount in the aqueous dispersion uniformly act on the elastomer particles, as a result of which coagulation can be rapidly completed at a specific thermal coagulation temperature. As a result, the elastomer coagulation can proceed in a state where a large amount of moisture is contained in the fibrous base material. As a result, it is possible to achieve good flexibility and repulsive feeling similar to natural leather. Furthermore, by setting the content within the above range, excessive aggregation and curing of the elastomer can be suppressed, and formation of a film-shaped object of the elastomer can also be suppressed. On the other hand, when the content is 100 parts by mass or less, the elastomer is cured in an appropriate size, so that deterioration of physical properties can be suppressed. Further, the stability of the aqueous dispersion can also be maintained.

Next, the aqueous dispersion contains a crosslinker. By using the crosslinker, the elastomer has a three-dimensional network structure, and the sheet material is excellent in wear resistance and the like. Furthermore, by concurrently using the monovalent cation-containing inorganic salt described above, the coagulation of the elastomer precursor and the reaction of the elastomer precursor and the crosslinker are simultaneously advanced, so that it is possible to form a dense three-dimensional network structure and control the adhesive structure of the fibers, and it is possible to make the sheet material more soft, and it is also possible to achieve high physical properties, high light resistance, and high heat resistance of the sheet material.

The aqueous dispersion may contain 40% by mass or less of a water-soluble organic solvent such as a ketone-based solvent such as acetone, ethyl methyl ketone, or diethyl ketone in 100% by mass of the aqueous dispersion in order to improve storage stability and film formability. However, the content of the organic solvent is preferably 1% by mass or less from the viewpoint of the maintenance of the working environment, the viewpoint of wastewater treatment recovery, and the like.

(1-b) Heat Drying Treatment

In this step, an elastomer is formed by impregnating a fibrous base material made of ultrafine fiber-generating fibers with an aqueous dispersion, and then subjecting the fibrous base material impregnated with the aqueous dispersion to a heat drying treatment at a temperature of 100° C. or higher and 180° C. or lower.

The temperature of the fibrous base material in the heat drying treatment is 100° C. or higher and 180° C. or lower. By setting the temperature of the fibrous base material to 100° C. or higher, preferably 120° C. or higher, and more preferably 140° C. or higher, the elastomer precursor is quickly coagulated, and uneven distribution of the elastomer on the lower surface of the sheet due to its own weight can be suppressed. In addition, the crosslinking reaction between the elastomer precursor and the crosslinker can be sufficiently promoted to form a three-dimensional network structure, and the physical properties, light resistance, and heat resistance of the sheet material can be improved. On the other hand, when the temperature of the fibrous base material is 180° C. or lower, preferably 175° C. or lower, thermal deterioration of the elastomer can be suppressed.

(2) Ultrafine Fiber Generating Step

In this step, ultrafine fibers are generated from the ultrafine fiber-generating fibers to form a fibrous base material made of the ultrafine fibers.

By generating the ultrafine fiber after the first elastomer precursor impregnation step, that is, after adding the elastomer once, for example, when the ultrafine fiber-generating fiber is a sea-island composite fiber, spaces formed by dissolving the island component can be formed, and thus the elastomer does not firmly bind the ultrafine fiber, and the texture of the sheet material becomes more soft.

In this step, when the ultrafine fiber-generating fiber is a sea-island composite fiber, an ultrafine fiber-generating treatment (sea-removing treatment) may be carried out by immersing the sea-island composite fibers in a solvent and by squeezing them. As the solvent for dissolving the sea component, it is possible to use an alkaline aqueous solution such as sodium hydroxide, or hot water.

In the ultrafine fiber generating step, instruments such as continuous dyeing machine, vibro washer type sea component removing machine, jet dyeing machine, wince dyeing machine, and jigger dyeing machine can be used for generating of the ultrafine fibers.

When an alkali aqueous solution or the like is used after the ultrafine fiber generating step, it is preferable to perform a sufficient washing step after the treatment. By undergoing the washing step, it is possible to process the sheet material without the alkali or the excessive monovalent cation-containing inorganic salt remaining in the sheet, the excessive monovalent cation-containing inorganic salt adhering to the sheet material, and it is possible to process the sheet material without affecting the production facility. Water is preferably used as a cleaning liquid in consideration of environmental aspects and safety.

(3) Second Elastomer Precursor Impregnation Step

In this step, an elastomer is further formed by impregnating a fibrous base material made of ultrafine fibers with an aqueous dispersion containing an elastomer precursor having a hydrophilic group, a monovalent cation-containing inorganic salt, and a crosslinker, and then subjecting the fibrous base material impregnated with the aqueous dispersion to a heat drying treatment at a temperature of 100° C. or higher and 180° C. or lower.

The aqueous dispersion used in this step is the same as the aqueous dispersion used in the first elastomer precursor impregnation step. As described above, the same elastomer precursor may be used, or different elastomer precursors may be used. Preferably, the first elastomer precursor is an elastomer precursor A containing polyether diol as a constituent, and the second elastomer precursor is an elastomer precursor B containing polycarbonate diol as a constituent. Both the elastomer A containing polyether diol as a constituent superior in flexibility and the elastomer B containing polycarbonate diol as a constituent superior in durability against external stimuli such as light and heat are contained in the sheet material, whereby a sheet material superior in flexibility and durability is easily obtained.

The heat drying treatment in this step is also similar to the heat drying treatment performed in the first elastomer precursor impregnation step.

(4) Other Steps

In the present invention, at least one surface of the sheet material may be subjected to a nap raising treatment to form a nap on the surface. The method for forming the nap is not particularly limited, and various methods usually performed in the art such as buffing with sandpaper or the like can be used. When the length of the nap is too short, it is difficult to obtain an elegant appearance, and when the length of the nap is too long, pilling tends to occur. Therefore, the length of the nap is preferably 0.2 mm or more and 1 mm or less.

In one embodiment of the present invention, the sheet material can be dyed. As the dyeing method, various methods usually used in the art can be adopted. Since the sheet material can be made flexible by adding a softening effect at the same time of dyeing of the sheet material, a method using a jet dyeing machine is preferable.

Although depending on the kind of fiber, the dyeing temperature is preferably set to 80° C. or higher and 150° C. or lower. The dyeing temperature is set to 80° C. or higher, and more preferably 110° C. or higher, so that it is possible to efficiently dye the fiber. Meanwhile, the dyeing temperature is set to 150° C. or lower, and more preferably 130° C. or lower, so that it is possible to prevent deterioration of the elastomer.

The dye used in the present invention is not particularly limited as long as the dye is appropriately selected depending on the type of the fibers constituting the fibrous base material. For example, when the fibers are polyester-based fibers, a disperse dye can be used. When the fibers are polyamide-based fibers, an acid dye, a premetallized dye, or a combination thereof can be used. When the sheet material is dyed with the disperse dye, the sheet material may be subjected to reduction cleaning after the dyeing.

It is also preferable to use a dyeing auxiliary at the time of dyeing. The dyeing auxiliary is used, so that the evenness and reproducibility of dyeing can be improved. The fiber may be further subjected to finishing agent treatment using a softening agent such as silicone, an antistatic agent, a water repellent agent, a flame retardant, a light resisting agent, an antibacterial agent or the like in the same bath as that used for the dyeing or after the dyeing.

EXAMPLES

Next, the present invention will be described in detail, based on Examples. However, the present invention is not limited only to Examples. Unless otherwise described, physical properties are measured based on the above methods.

[Evaluation Method]

(1) Average Single-Fiber Diameter of Ultrafine Fiber:

The ultrafine fibers constituting the sheet material were observed at a magnification of 3000 times using a scanning electron microscope (SEM, VE-7800, manufactured by KEYENCE CORPORATION), and the diameters of 50 single fibers randomly extracted in a field of view of 30 μm×30 μm were measured in μm units up to the first decimal place.

(2) Stiffness (Flexibility) of Sheet Material:

Based on the method A (45° cantilever method) in the text of 8.21.1 of 8.21 "Stiffness" of JIS L 1096:2010 "Testing Methods for Woven and Knitted Fabrics", 5 test pieces of 2×35 cm were prepared in the longitudinal. Each test piece was placed on a horizontal table having a slope at an angle of 45 degrees, and was made to glide. Next, when a middle point at one end of the test piece was in contact with the slope, the scale was read. Then, the values for the 5 test pieces were averaged.

(3) Thermal Coagulation Temperature of Aqueous Dispersion:

First, 20 g of aqueous dispersion prepared in the respect examples and comparative examples was put into a test tube with an inner diameter of 12 mm; a thermometer was inserted such that the tip is below the liquid level; and the test tube was then sealed and submerged in a hot water bath at a temperature of 95° C. such that the liquid level of aqueous dispersion was below the liquid level of the hot water bath. While the temperature rise inside the test tube was checked by the thermometer, the test tube was lifted, if appropriate, and was swung for 5 sec. or less per check so as to examine the presence or absence of fluidity of the aqueous dispersion at its surface. Then, the temperature at which the aqueous dispersion at its surface lost fluidity was defined as the thermal coagulation temperature of the aqueous dispersion. This measurement was triplicated per kind of aqueous dispersion, and then averaged.

(4) Identification of Bonded Types in Elastomer:

Regarding the elastomer separated from the sheet material, the bonded species were identified by infrared spectroscopic analysis using "FT/IR 4000 series", manufactured by JASCO Corporation.

(5) External Appearance of Sheet Material:

The surface appearance of the obtained sheet material was evaluated by 10 panelists, evaluated according to the following criteria, and the evaluation result with the largest number of people was adopted. The evaluation of the surface appearance was made by placing a sheet material 3 on an inspection table 2 at a position parallel to a floor surface 1 as illustrated in the figure, and visually checking the sheet material 3 at an angle of 45° from the inspection table plane with respect to the sheet material 3 so that a distance of a line 4 connecting the position to be visually checked and the sheet material was 50 cm. In addition, on the inspection table, a fluorescent lamp 6 of 32 W was installed 150 cm above the upper surface of the inspection table in the vertical direction. The sheet material 3 was placed immediately below the fluorescent lamp 6, that is, at a position where a perpendicular line 7 from the sheet material to the fluorescent lamp can be drawn, and the surface appearance was evaluated. For the appearance quality, grade 4 and grade 5 were regarded as good.

Grade 5: a uniform nap of the fibers is observed, a scattered state of the fibers is good, and the appearance is good.

Grade 4: the material is evaluated as between Grade 5 and Grade 3.

Grade 3: as the scattered state of the fibers, some of the fibers were not well separated, but the fibers are napped and the appearance is rather good.

Grade 2: the material is evaluated as between Grade 3 and Grade 1.

Grade 1: there were few nap of the fibers, and the scattered state of the fibers as a whole was very poor, and the appearance was poor.

(6) Abrasion Evaluation of Sheet Material after DMF Treatment (Chemical Resistance):

"Model 406", manufactured by James H. Heal & Co. Ltd., was used as a Martindale abrasion tester used for abrasion evaluation, and "ABRASTIVE CLOTH SM 25", manufactured by James H. Heal & Co. Ltd., was used as a standard friction cloth. Regarding the evaluation criteria, a sheet material having no change in appearance from that before abrasion was rated as grade 5, and a sheet material having 30 or more fuzzballs having a diameter of 1 mm or more was rated as grade 1. The grades 1 to 5 were divided in increments of 0.5. The mass of the sheet material before and after abrasion was used, and the wear loss was calculated by the following equation.

$$\text{Wear loss (mg)} = \text{mass before abrasion (mg)} - \text{mass after abrasion (mg)}$$

(7) Wet Tensile Strength Retention and Wet Tensile Elongation Retention (Dyeing Resistance):

As a constant-speed extension-type tensile tester, "Instron 3343" manufactured by Illinois Tool Works Inc. was used.

(8) Inorganic Salt Types and Measurement of Content Contained in Sheet Material:

A sheet material was immersed in N,N-dimethylformamide overnight, and a solution from which an elastomer and an inorganic salt had been eluted was concentrated by heating and drying at 140° C. for coagulation. Distilled water was added to the obtained solid, and only the inorganic salt was eluted. The aqueous solution containing the inorganic salt was heated and dried, and then the amount of the inorganic salt contained in the sheet material was measured. In addition, the weight of the solidified elastomer was also measured after heating and drying, and the weight of the inorganic salt with regard to the mass of the elastomer was calculated. However, from the viewpoint of the effectiveness of the numerical value, the content of less than 0.1% by mass relative to the elastomer is set to be less than the detection lower limit.

The kind of the inorganic salt in the aqueous solution containing the inorganic salt was identified using an ion chromatograph system of "ICS-3000 type", manufactured by Dionex Corporation.

(9) L Value Retention (Heat Resistance):

Measurement and calculation were performed by the above method using "CHP-250 DN" manufactured by AS ONE Corporation as a hot plate and "CR-410" manufactured by Konica Minolta, Inc. as a color difference meter.

(10) Amount of Fiber Fragments During Washing:

A test piece of 10 cm×10 cm (100 $cm^2$) was cut out from the sheet material, a washing test was performed by the above method, and the amount of fiber fragments was calculated. The measurement was performed twice, and the average value thereof was taken as the amount of fiber fragments at the time of washing.

Production Example 1: Preparation of Aqueous Dispersion Wa of Elastomer Precursor a A prepolymer was prepared in a toluene solvent using polytetramethylene ether glycol having a number average molecular weight (Mn) of 2000 as polymeric polyol, MDI as organic diisocyanate, and 2,2-dimethylolpropionic acid as an active hydrogen component-containing compound having a hydrophilic group. Further, ethylene glycol and ethylenediamine as chain extenders, polyoxyethylene nonylphenyl ether as an external emulsifier, and water were added and stirred. Toluene was removed under reduced pressure to obtain an aqueous dispersion Wa of an elastomer precursor a. The elastomer precursor a is an elastomer precursor corresponding to the elastomer A.

Production Example 2: Preparation of Aqueous Dispersion Wb of Elastomer Precursor b A prepolymer was prepared in an acetone solvent using polyhexamethylene carbonate having the number average molecular weight (Mn) of 2,000 as polymeric polyol, hydrogenated MDI as an organic diisocyanate, and a diol compound having polyethylene glycol in a side chain, and 2,2-dimethylol propionic acid as an active hydrogen component-containing compound having a hydrophilic group. Ethylene glycol and ethylenediamine as chain extenders and water were added, and the mixture was stirred. Acetone was removed under reduced pressure to obtain an aqueous dispersion Wb of an elastomer precursor b. The elastomer precursor b is an elastomer precursor corresponding to the elastomer B.

Example 1

(Ultrafine Fiber-Generating Nonwoven Fabric)

A sea-island composite fiber having a composite ratio of 20% by mass of a sea component to 80% by mass of an island component, a number of islands of 16 islands/i filament, and an average fiber diameter of 20 μm was obtained using, as the sea component, polyethylene terephthalate copolymerized with 8 mol % of sodium 5-sulfoisophthalate, and as the island component, polyethylene terephthalate. The obtained sea-island composite fiber was cut into a staple having a fiber length of 51 mm, the staple was passed on a carding machine and a cross lapper to form a fiber web, and the fiber web was formed into a nonwoven fabric by needle punching. The nonwoven fabric thus obtained was immersed and contracted in hot water at a temperature of 97° C. for 2 minutes, and was then dried at a temperature of 100° C. for 5 minutes.

(Addition of First Elastomer Resin)

35 parts by mass of sodium sulfate (designated as "$Na_2SO_4$" in Table 1) as a thermosensitive coagulant and 3 parts by mass of a carbodiimide-based crosslinker were added to 100 parts by mass of the elastomer precursor a, and the whole of the mixture was adjusted to a solid content of 11% by mass using water, thereby preparing an aqueous dispersion Wa containing an elastomer precursor a. The thermal coagulation temperature was 65° C. The obtained fibrous base material nonwoven fabric was immersed in the aqueous dispersion, and then dried with hot air at a temperature of 160° C. for 20 minutes to obtain an elastomer-added nonwoven fabric in which 10% by mass of the elastomer A was added with regard to the fiber weight.

(Making Fibers Ultrafine)

The obtained elastomer-added nonwoven fabric was immersed and treated for 30 minutes in a sodium hydroxide aqueous solution that was heated to a temperature of 95° C. and was at a concentration of 8 g/L. Then, a sheet (elastomer-added ultrafine fiber nonwoven fabric) made of ultrafine fibers, in which the sea component had been removed from the sea-island composite fibers, was obtained.

(Addition of Second Elastomer Resin)

35 parts by mass of sodium sulfate as a thermosensitive coagulant and 3 parts by mass of a carbodiimide-based crosslinker were added to 100 parts by mass of the elastomer precursor b, and the whole of the mixture was adjusted to a solid content of 11% by mass using water, thereby preparing an aqueous dispersion Wb containing an elastomer precursor b. The thermal coagulation temperature was 65° C. The obtained fibrous base material nonwoven fabric was immersed in the aqueous dispersion, and then dried with hot air at a temperature of 160° C. for 20 minutes to obtain an elastomer-added nonwoven fabric in which 10% by mass of the elastomer B was added with regard to the fiber weight.

(For Cutting in Half and Nap Raising)

The obtained elastomer resin-added sheet was cut in half in a direction perpendicular to the thickness direction. The side opposite to the half-cutting surface was subjected to grinding with an endless sandpaper of sandpaper No. 240 to obtain a sheet material having a nap with a thickness of 0.7 mm.

(For Dyeing and Finishing)

The obtained sheet material having a nap was dyed with a black dye by using a jet dyeing machine under conditions at a temperature of 120° C. Then, drying was performed with a dryer to obtain a sheet material having ultrafine fibers with an average individual fiber fineness of 4.4 μm. The obtained sheet material had a stiffness of 84 mm, a surface appearance of grade 5, wear resistance after DMF treatment of grade 4.5/wear loss of 7.6 mg, a wet tensile strength retention of 83%/tensile elongation retention of 119%, and had a soft texture and excellent chemical resistance and dyeing resistance. In addition, a polyether bond, a polycarbonate bond, an N-acylurea bond, and an isourea bond were present in the elastomer. Here, the expression "an N-acylurea bond, and an isourea bond were present in the elastomer" means that the elastomer has an N-acylurea bond and/or an isourea bond. The amount of the inorganic salt in the elastomer was less than the detection lower limit. Furthermore, the L value retention was 97%, and the heat resistance was superior. In addition, the amount of fiber fragments during washing was 2.9 (mg/100 $cm^2$ of the sheet material), indicating a low environmental load.

Example 2

A sheet material having an average individual fiber fineness of ultrafine fibers of 4.4 μm was obtained in the same manner as in Example 1 except that adding 3 parts by mass of a carbodiimide-based crosslinker as a crosslinker in (addition of first elastomer resin) of Example 1 was changed to adding 3 parts by mass of a blocked isocyanate-based crosslinker. The obtained sheet material had a stiffness of 94 mm, a surface appearance of grade 5, wear resistance after DMF treatment of grade 4.5/wear loss of 7.8 mg, a wet tensile strength retention of 81%/tensile elongation retention of 119%, and had a soft texture and excellent chemical resistance and dyeing resistance. In addition, a polyether bond, a polycarbonate bond, an N-acylurea bond, and an isourea bond were present in the elastomer. The amount of the inorganic salt in the elastomer was less than the detection lower limit. Furthermore, the L value retention was 93%, and the heat resistance was excellent. In addition, the amount of fiber fragments during washing was 3.1 (mg/100 $cm^2$ of the sheet material), indicating a low environmental load.

Example 3

A sheet material having an average individual fiber fineness of ultrafine fibers of 4.4 μm was obtained in the same manner as in Example 1 except that adding 3 parts by mass of a carbodiimide-based crosslinker as a crosslinker in (addition of second elastomer resin) of Example 1 was changed to adding 3 parts by mass of a blocked isocyanate-based crosslinker. The obtained sheet material had a stiffness of 89 mm, a surface appearance of grade 5, wear resistance after DMF treatment of grade 4.5/wear loss of 8.5 mg, a wet tensile strength retention of 80%/tensile elongation retention of 114%, and had a soft texture and excellent chemical resistance and dyeing resistance. In addition, a polyether bond, a polycarbonate bond, an N-acylurea bond, and an isourea bond were present in the elastomer. The amount of the inorganic salt in the elastomer was less than the detection lower limit. Furthermore, the L value retention was 94%, and the heat resistance was excellent. In addition, the amount of fiber fragments during washing was 3.4 (mg/100 $cm^2$ of the sheet material), indicating a low environmental load.

Example 4

A sheet material having an average individual fiber fineness of ultrafine fibers of 4.4 μm was obtained in the same manner as in Example 1 except for changing the use of the elastomer precursor b as the elastomer precursor in (addition of second elastomer resin) of Example 1 to the use of the elastomer precursor a. The obtained sheet material had a stiffness of 82 mm, a surface appearance of grade 4.5, wear resistance after DMF treatment of grade 4/wear loss of 8.8 mg, a wet tensile strength retention of 77%/tensile elongation retention of 122%, and had a soft texture and excellent chemical resistance and dyeing resistance. In addition, a polyether bond, an N-acylurea bond, and an isourea bond were present in the elastomer. The amount of the inorganic salt in the elastomer was less than the detection lower limit. Furthermore, the L value retention was 93%, and the heat resistance was excellent. In addition, the amount of fiber fragments during washing was 3.4 (mg/100 $cm^2$ of the sheet material), indicating a low environmental load.

Example 5

A sheet material having an average individual fiber fineness of ultrafine fibers of 4.4 μm was obtained in the same manner as in Example 1 except for changing the use of the elastomer precursor a as the elastomer precursor in (addition of first elastomer resin) of Example 1 to the use of the elastomer precursor b. The obtained sheet material had a stiffness of 98 mm, a surface appearance of grade 4, wear resistance after DMF treatment of grade 4.5/wear loss of 7.7 mg, a wet tensile strength retention of 84%/tensile elongation retention of 111%, and had a soft texture and excellent chemical resistance and dyeing resistance. In addition, a polycarbonate bond, an N-acylurea bond, and an isourea bond were present in the elastomer. The amount of the inorganic salt in the elastomer was less than the detection lower limit. Furthermore, the L value retention was 96%, and the heat resistance was excellent. In addition, the amount of fiber fragments during washing was 2.8 (mg/100 $cm^2$ of the sheet material), indicating a low environmental load.

Example 6

A sheet material having an average individual fiber fineness of ultrafine fibers of 4.4 μm was obtained in the same manner as in Example 1 except that adding 35 parts by mass of sodium sulfate as a thermosensitive coagulant in (addition of first elastomer resin) of Example 1 was changed to adding 12 parts by mass and the thermal coagulation temperature was adjusted to 70° C. The obtained sheet material had a stiffness of 94 mm, a surface appearance of grade 4, wear resistance after DMF treatment of grade 4/wear loss of 7.7 mg, a wet tensile strength retention of 83%/tensile elongation retention of 117%, and had a soft texture and excellent chemical resistance and dyeing resistance. In addition, a polyether bond, a polycarbonate bond, an N-acylurea bond, and an isourea bond were present in the elastomer. The amount of the inorganic salt in the elastomer was less than the detection lower limit. Furthermore, the L value retention was 90%, and the heat resistance was excellent. In addition, the amount of fiber fragments during washing was 2.8 (mg/100 $cm^2$ of the sheet material), indicating a low environmental load.

Example 7

A sheet material having an average individual fiber fineness of ultrafine fibers of 4.4 μm was obtained in the same manner as in Example 1 except that adding 35 parts by mass of sodium sulfate as a thermosensitive coagulant in (addition of first elastomer resin) of Example 1 was changed to adding 86 parts by mass and the thermal coagulation temperature was adjusted to 60° C. The obtained sheet material had a stiffness of 80 mm, a surface appearance of grade 4, wear resistance after DMF treatment of grade 4/wear loss of 13.5 mg, a wet tensile strength retention of 80%/tensile elongation retention of 115%, and had a soft texture and excellent chemical resistance and dyeing resistance. In addition, a polyether bond, a polycarbonate bond, an N-acylurea bond, and an isourea bond were present in the elastomer. The amount of the inorganic salt in the elastomer was less than the detection lower limit. Furthermore, the L value retention was 91%, and the heat resistance was excellent. In addition, the amount of fiber fragments during washing was 5.4 (mg/100 $cm^2$ of the sheet material), indicating a low environmental load.

Example 8

A sheet material having an average individual fiber fineness of ultrafine fibers of 4.4 μm was obtained in the same manner as in Example 1 except that adding 35 parts by mass of sodium sulfate as a thermosensitive coagulant in (addition of second elastomer resin) of Example 1 was changed to adding 12 parts by mass and the thermal coagulation temperature was adjusted to 70° C. The obtained sheet material had a stiffness of 98 mm, a surface appearance of grade 4, wear resistance after DMF treatment of grade 4/wear loss of 8.0 mg, a wet tensile strength retention of 83%/tensile elongation retention of 114%, and had a soft texture and excellent chemical resistance and dyeing resistance. In addition, a polyether bond, a polycarbonate bond, an N-acylurea bond, and an isourea bond were present in the elastomer. The amount of the inorganic salt in the elastomer was less than the detection lower limit. Furthermore, the L value retention was 91%, and the heat resistance was excellent. In addition, the amount of fiber fragments during washing was 2.6 (mg/100 $cm^2$ of the sheet material), indicating a low environmental load.

Example 9

A sheet material having an average individual fiber fineness of ultrafine fibers of 4.4 μm was obtained in the same manner as in Example 1 except that adding 35 parts by mass of sodium sulfate as a thermosensitive coagulant in (addition of second elastomer resin) of Example 1 was changed to adding 86 parts by mass and the thermal coagulation temperature was adjusted to 60° C. The obtained sheet material had a stiffness of 88 mm, a surface appearance of grade 4, wear resistance after DMF treatment of grade 4/wear loss of 14.1 mg, a wet tensile strength retention of 81%/tensile elongation retention of 113%, and had a soft texture and excellent chemical resistance and dyeing resistance. In addition, a polyether bond, a polycarbonate bond, an N-acylurea bond, and an isourea bond were present in the elastomer. The amount of the inorganic salt in the elastomer was less than the detection lower limit. Furthermore, the L value retention was 93%, and the heat resistance was excellent. In addition, the amount of fiber fragments during washing was 5.8 (mg/100 $cm^2$ of the sheet material), indicating a low environmental load.

Example 10

A sheet material having an average individual fiber fineness of ultrafine fibers of 4.4 μm was obtained in the same manner as in Example 1 except that adding 35 parts by mass of sodium sulfate as a thermosensitive coagulant in (addition of the first elastomer resin) of Example 1 to adding 30 parts by mass of sodium chloride (denoted as "NaCl" in Table 1) and the thermal coagulation temperature was adjusted to 65° C., and further adding 35 parts by mass of sodium sulfate as a thermosensitive coagulant in (addition of second elastomer resin) of Example 1 was changed to adding 30 parts by mass of sodium chloride and the thermal coagulation temperature was adjusted to 65° C. The obtained sheet material had a stiffness of 86 mm, a surface appearance of grade 5, wear resistance after DMF treatment of grade 4.5/wear loss of 7.4 mg, a wet tensile strength retention of 83%/tensile elongation retention of 119%, and had a soft texture and excellent chemical resistance and dyeing resistance. In addition, a polyether bond, a polycarbonate bond, an N-acylurea bond, and an isourea bond were present in the elastomer. The amount of the inorganic salt in the elastomer was less than the detection lower limit. Furthermore, the L value retention was 96%, and the heat resistance was excellent. In addition, the amount of fiber fragments during washing was 2.9 (mg/100 $cm^2$ of the sheet material), indicating a low environmental load.

Comparative Example 1

A sheet material having an average individual fiber fineness of ultrafine fibers of 4.4 μm was obtained in the same manner as in Example 1 except that the step of (addition of second elastomer resin) in Example 1 was not performed. The obtained sheet material had a stiffness of 81 mm, a surface appearance of grade 5, wear resistance after DMF treatment of grade 2/wear loss of 33.5 mg, a wet tensile strength retention of 72%/tensile elongation retention of 103%, had a soft texture, and excellent heat resistance with an L value retention of 93%, but had poor chemical resistance and dyeing resistance. In addition, the amount of fiber fragments during washing was 12.5 (mg/100 $cm^2$ of the sheet material), indicating a large environmental load. Note that, a polyether bond, an N-acylurea bond, and an isourea bond were present in the elastomer. The amount of the inorganic salt in the elastomer was less than the detection lower limit.

Comparative Example 2

A sheet material having an average individual fiber fineness of ultrafine fibers of 4.4 μm was obtained in the same manner as in Comparative Example 1 except for using the elastomer precursor b as the elastomer precursor in (addition of first elastomer resin) of Comparative Example 1. The obtained sheet material had a stiffness of 92 mm, a surface appearance of grade 3.5, wear resistance after DMF treatment of grade 2/wear loss of 29.9 mg, a wet tensile strength retention of 73%/tensile elongation retention of 101%, had a soft texture, and excellent heat resistance with an L value retention of 94%, but had poor chemical resistance and dyeing resistance. In addition, the amount of fiber fragments during washing was 11.4 (mg/100 $cm^2$ of the sheet material), indicating a large environmental load. In addition, a polycarbonate bond, an N-acylurea bond, and an isourea bond were present in the elastomer. The amount of the inorganic salt in the elastomer was less than the detection lower limit.

Comparative Example 3

A sheet material having an average individual fiber fineness of ultrafine fibers of 4.4 μm was obtained in the same manner as in Example 1 except that a thermosensitive coagulant was not added in (addition of first elastomer resin) of Example 1. The obtained sheet material had a stiffness of 150 mm or more, a surface appearance of grade 2, wear resistance after DMF treatment of grade 4/wear loss of 7.4 mg, a wet tensile strength retention of 84%/tensile and elongation retention of 109%, and had excellent chemical resistance and dyeing resistance, and the amount of fiber fragments during washing was 2.8 (mg/sheet material 100 $cm^2$), indicating a low environmental load, but a hard texture. Furthermore, the L value retention was 84%, and the heat resistance was not sufficient. In addition, a polyether bond, a polycarbonate bond, an N-acylurea bond, and an isourea bond were present in the elastomer. The amount of the inorganic salt in the elastomer was less than the detection lower limit.

Comparative Example 4

A sheet material having an average individual fiber fineness of ultrafine fibers of 4.4 μm was obtained in the same manner as in Example 1 except that a thermosensitive coagulant was not added in (addition of second elastomer resin) of Example 1. The obtained sheet material had a stiffness of 150 mm or more, a surface appearance of grade 2, wear resistance after DMF treatment of grade 4/wear loss of 7.1 mg, a wet tensile strength retention of 82%/tensile elongation retention of 110%, and had excellent chemical resistance and dyeing resistance, and the amount of fiber fragments during washing was 3.0 (mg/sheet material 100 $cm^2$), indicating a low environmental load, but a hard texture. Furthermore, the L value retention was 86%, and the heat resistance was not sufficient. In addition, a polyether bond, a polycarbonate bond, an N-acylurea bond, and an isourea bond were present in the elastomer. The amount of the inorganic salt in the elastomer was less than the detection lower limit.

Comparative Example 5

A sheet material having an average individual fiber fineness of ultrafine fibers of 4.4 μm was obtained in the same manner as in Example 1 except that adding 35 parts by mass of sodium sulfate as a thermosensitive coagulant in (addition of first elastomer resin) of Example 1 was changed to adding 5 parts by mass and the thermal coagulation temperature was adjusted to 85° C. The obtained sheet material had a stiffness of 144 mm, a surface appearance of grade 2.5, wear resistance after DMF treatment of grade 4/wear loss of 8.0 mg, a wet tensile strength retention of 82%/tensile elongation retention of 111%, and had excellent chemical resistance and dyeing resistance, and the amount of fiber fragments during washing was 2.6 (mg/sheet material 100 $cm^2$), indicating a low environmental load, but a hard texture. Furthermore, the L value retention was 85%, and the heat resistance was not sufficient. In addition, a polyether bond, a polycarbonate bond, an N-acylurea bond, and an isourea bond were present in the elastomer. The amount of the inorganic salt in the elastomer was less than the detection lower limit.

Comparative Example 6

A sheet material having an average individual fiber fineness of ultrafine fibers of 4.4 μm was obtained in the same manner as in Example 1 except that adding 35 parts by mass of sodium sulfate as a thermosensitive coagulant in (addition of first elastomer resin) of Example 1 was changed to adding 120 parts by mass and the thermal coagulation temperature was adjusted to 50° C. The obtained sheet material had a stiffness of 84 mm, a surface appearance of grade 1.5, wear resistance after DMF treatment of grade 3/wear loss of 21.2 mg, a wet tensile strength retention of 80%/tensile elongation retention of 114%, had a soft texture and good dyeing resistance, had constant heat resistance with an L value retention of 90%, and had the amount of fiber fragments during washing of 8.8 (mg/100 $cm^2$ of the sheet material), which was small in environmental load, but had poor chemical resistance and quality. Note that, an N-acylurea bond and an isourea bond were present in the elastomer. In addition, a polyether bond, a polycarbonate bond, an N-acylurea bond, and an isourea bond were present in the elastomer. The amount of the inorganic salt in the elastomer was less than the detection lower limit.

Comparative Example 7

A sheet material having an average individual fiber fineness of ultrafine fibers of 4.4 μm was obtained in the same manner as in Example 1 except that adding 35 parts by mass of sodium sulfate as a thermosensitive coagulant in (addition of second elastomer resin) of Example 1 was changed to adding 5 parts by mass and the thermal coagulation temperature was adjusted to 85° C. The obtained sheet material had a stiffness of 148 mm, a surface appearance of grade 2.5, wear resistance after DMF treatment of grade 4/wear loss of 7.8 mg, a wet tensile strength retention of 77%/tensile elongation retention of 120%, and had excellent chemical resistance and dyeing resistance, and the amount of fiber fragments during washing was 2.6 (mg/sheet material 100 $cm^2$), indicating a low environmental load, but a hard texture. Furthermore, the L value retention was 87%, and the heat resistance was not sufficient. In addition, a polyether bond, a polycarbonate bond, an N-acylurea bond, and an isourea bond were present in the elastomer. The amount of the inorganic salt in the elastomer was less than the detection lower limit.

Comparative Example 8

A sheet material having an average individual fiber fineness of ultrafine fibers of 4.4 μm was obtained in the same manner as in Example 1 except that adding 35 parts by mass of sodium sulfate as a thermosensitive coagulant in (addition of second elastomer resin) of Example 1 was changed to adding 120 parts by mass and the thermal coagulation temperature was adjusted to 50° C. The obtained sheet material had a stiffness of 86 mm, a surface appearance of grade 1.5, wear resistance after DMF treatment of grade 3/wear loss of 32.7 mg, a wet tensile strength retention of 74%/tensile elongation retention of 113%, and had a soft texture and excellent dyeing resistance, but had poor chemical resistance and quality. Furthermore, the L value retention was 89%, and the heat resistance was not sufficient. In addition, the amount of fiber fragments during washing was 12.1 (mg/100 $cm^2$ of the sheet material), indicating a large environmental load. In addition, a polyether bond, a polycarbonate bond, an N-acylurea bond, and an isourea bond were present in the elastomer. The amount of the inorganic salt in the elastomer was less than the detection lower limit.

Comparative Example 9

A sheet material having an average individual fiber fineness of ultrafine fibers of 4.4 μm was obtained in the same manner as in Example 1 except that a crosslinker was not added in (addition of first elastomer resin) of Example 1 and a crosslinker was not added in (addition of second elastomer resin) of Example 1 as well. The obtained sheet material had a stiffness of 96 mm, a surface appearance of grade 3, wear resistance after DMF treatment of grade 2/wear loss of 32.0 mg, a wet tensile strength retention of 71%/tensile elongation retention of 97%, and had a good texture, but had poor chemical resistance and dyeing resistance. Furthermore, the L value retention was 88%, and the heat resistance was not sufficient. In addition, the amount of fiber fragments during washing was 13.6 (mg/100 $cm^2$ of the sheet material), indicating a large environmental load. In addition, a polyether bond, a polycarbonate bond, an N-acylurea bond, and an isourea bond were not present in the elastomer. The amount of the inorganic salt in the elastomer was less than the detection lower limit.

Comparative Example 10

A sheet material having an average individual fiber fineness of ultrafine fibers of 4.4 μm was obtained in the same manner as in Example 1 except that 3% by mass of a blowing agent (AIBN) was added instead of the thermosensitive coagulant added in (addition of first elastomer resin) of Example 1. The obtained sheet material had a stiffness of 145 mm, a surface appearance of grade 2, wear resistance after DMF treatment of grade 3/wear loss of 19.5 mg, a wet tensile strength retention of 77%/tensile elongation retention of 107%, and had excellent dyeing resistance, and the amount of fiber fragments during washing was 9.1 (mg/sheet material 100 $cm^2$), indicating a low environmental load, but a poor texture, quality, and chemical resistance. Furthermore, the L value retention was 88%, and the heat resistance was not sufficient. In addition, a polyether bond, a polycarbonate bond, an N-acylurea bond, and an isourea bond were present in the elastomer. The amount of the inorganic salt in the elastomer was less than the detection lower limit.

Comparative Example 11

A sheet material having an average individual fiber fineness of ultrafine fibers of 4.4 μm was obtained in the same manner as in Example 1 except that a polycarbonate-based elastomer precursor dissolved in DMF was used as the elastomer precursor in (addition of second elastomer resin) of Example 1. The obtained sheet material had a stiffness of 97 mm, a surface appearance of grade 3, wear resistance after DMF treatment of grade 2/wear loss of 42.7 mg, a wet tensile strength retention of 81%/tensile elongation retention of 118%, and had soft texture and excellent dyeing resistance, and the amount of fiber fragments during washing was 2.7 (mg/sheet material 100 $cm^2$), indicating a low environmental load, but a poor chemical resistance. Furthermore, the L value retention was 88%, and the heat resistance was not sufficient. In addition, a polyether bond, a polycarbonate bond, an N-acylurea bond, and an isourea bond were present in the elastomer. The amount of the inorganic salt in the elastomer was less than the detection lower limit.

Comparative Example 12

Adding 35 parts by mass of sodium sulfate as a thermosensitive coagulant in (addition of second elastomer resin) of Example 1 was changed to adding 35 parts by mass of magnesium sulfate (described as "$MgSO_4$" in Table 1), 3% by mass of a carbodiimide-based crosslinker was added, and the whole was adjusted to a solid content of 11% by mass with water to obtain an aqueous dispersion containing an elastomer a. However, the elastomer was gelled on the surface of the nonwoven fabric during processing, and the elastomer was not able to be added to the nonwoven fabric.

The results of Examples 1 to 10 and Comparative Examples 1 to 12 described above are summarized in Tables 1 to 4.

TABLE 1

| | Aqueous dispersion (Wa) containing an elastomer having a hydrophilic group Before removing sea component | | | | |
|---|---|---|---|---|---|
| | Elastomer precursor | | Thermosensitive coagulant | | |
| | Type | Polyol | Type | Additive amount (parts by mass) | Crosslinker |
| Example 1 | a | Polyether | $Na_2SO_4$ | 35 | Carbodiimide-based |
| Example 2 | a | Polyether | $Na_2SO_4$ | 35 | Blocked isocyanate-based |
| Example 3 | a | Polyether | $Na_2SO_4$ | 35 | Carbodiimide-based |
| Example 4 | a | Polyether | $Na_2SO_4$ | 35 | Carbodiimide-based |
| Example 5 | b | Polycarbonate | $Na_2SO_4$ | 35 | Carbodiimide-based |
| Example 6 | a | Polyether | $Na_2SO_4$ | 12 | Carbodiimide-based |
| Example 7 | a | Polyether | $Na_2SO_4$ | 86 | Carbodiimide-based |
| Example 8 | a | Polyether | $Na_2SO_4$ | 35 | Carbodiimide-based |
| Example 9 | a | Polyether | $Na_2SO_4$ | 35 | Carbodiimide-based |
| Example 10 | a | Polyether | NaCl | 30 | Carbodiimide-based |
| Comparative Example 1 | a | Polyether | $Na_2SO_4$ | 35 | Carbodiimide-based |
| Comparative Example 2 | b | Polycarbonate | $Na_2SO_4$ | 35 | Carbodiimide-based |
| Comparative Example 3 | a | Polyether | Absence | Absence | Carbodiimide-based |
| Comparative Example 4 | a | Polyether | $Na_2SO_4$ | 35 | Carbodiimide-based |
| Comparative Example 5 | a | Polyether | $Na_2SO_4$ | 5 | Carbodiimide-based |
| Comparative Example 6 | a | Polyether | $Na_2SO_4$ | 120 | Carbodiimide-based |
| Comparative Example 7 | a | Polyether | $Na_2SO_4$ | 35 | Carbodiimide-based |
| Comparative Example 8 | a | Polyether | $Na_2SO_4$ | 35 | Carbodiimide-based |
| Comparative Example 9 | a | Polyether | $Na_2SO_4$ | 35 | Absence |
| Comparative Example 10 | a | Polyether | AIBN | 3 | Carbodiimide-based |
| Comparative Example 11 | a | Polyether | $Na_2SO_4$ | 35 | Carbodiimide-based |
| Comparative Example 12 | a | Polyether | $MgSO_4$ | 35 | Carbodiimide-based |

TABLE 2

| | Aqueous dispersion (Wb) containing an elastomer having a hydrophilic group After removing sea component | | | | |
|---|---|---|---|---|---|
| | Elastomer precursor | | Thermosensitive coagulant | | |
| | Type | Polyol | Type | Additive amount (parts by mass) | Crosslinker |
| Example 1 | b | Polycarbonate | $Na_2SO_4$ | 35 | Carbodiimide-based |
| Example 2 | b | Polycarbonate | $Na_2SO_4$ | 35 | Carbodiimide-based |
| Example 3 | b | Polycarbonate | $Na_2SO_4$ | 35 | Blocked isocyanate-based |
| Example 4 | a | Polyether | $Na_2SO_4$ | 35 | Carbodiimide-based |
| Example 5 | b | Polycarbonate | $Na_2SO_4$ | 35 | Carbodiimide-based |
| Example 6 | b | Polycarbonate | $Na_2SO_4$ | 35 | Carbodiimide-based |
| Example 7 | b | Polycarbonate | $Na_2SO_4$ | 35 | Carbodiimide-based |
| Example 8 | b | Polycarbonate | $Na_2SO_4$ | 12 | Carbodiimide-based |
| Example 9 | b | Polycarbonate | $Na_2SO_4$ | 86 | Carbodiimide-based |
| Example 10 | b | Polycarbonate | NaCl | 30 | Carbodiimide-based |
| Comparative Example 1 | Absence | Absence | Absence | Absence | Absence |
| Comparative Example 2 | Absence | Absence | Absence | Absence | Absence |
| Comparative Example 3 | B | Polycarbonate | $Na_2SO_4$ | 35 | Carbodiimide-based |
| Comparative Example 4 | b | Polycarbonate | Absence | Absence | Carbodiimide-based |
| Comparative Example 5 | b | Polycarbonate | $Na_2SO_4$ | 35 | Carbodiimide-based |
| Comparative Example 6 | b | Polycarbonate | $Na_2SO_4$ | 35 | Carbodiimide-based |
| Comparative Example 7 | b | Polycarbonate | $Na_2SO_4$ | 5 | Carbodiimide-based |
| Comparative Example 8 | b | Polycarbonate | $Na_2SO_4$ | 120 | Carbodiimide-based |
| Comparative Example 9 | b | Polycarbonate | $Na_2SO_4$ | 35 | Absence |
| Comparative Example 10 | b | Polycarbonate | $Na_2SO_4$ | 35 | Carbodiimide-based |
| Comparative Example 11 | Absence | DMF-dissolved elastomer | Absence | Absence | Absence |
| Comparative Example 12 | Absence | Absence | Absence | Absence | Absence |

TABLE 3-1

| | Stiffness (mm) | Presence or absence of polyether bond | Presence or absence of polycarbonate bond | Presence or absence of N-acylurea bond/isourea bond | Appearance quality (Grade) | Wear resistance after DMF treatment (Wear loss (mg)/grade) |
|---|---|---|---|---|---|---|
| Example 1 | 84 | Presence | Presence | Presence | 5 | 7.6 /4.5 |
| Example 2 | 94 | Presence | Presence | Presence | 5 | 7.8/4.5 |
| Example 3 | 89 | Presence | Presence | Presence | 5 | 8.5/4.5 |
| Example 4 | 82 | Presence | Absence | Presence | 4.5 | 8.8/4 |
| Example 5 | 98 | Absence | Presence | Presence | 4 | 7.7/4.5 |
| Example 6 | 94 | Presence | Presence | Presence | 4 | 7.7/4 |
| Example 7 | 80 | Presence | Presence | Presence | 4 | 13.5/4 |
| Example 8 | 98 | Presence | Presence | Presence | 4 | 8.0/4 |
| Example 9 | 88 | Presence | Presence | Presence | 4 | 14.1/4 |
| Example 10 | 86 | Presence | Presence | Presence | 5 | 7.4/4.5 |

TABLE 3-2

| | Wet tensile strength retention (%) | Wet tensile elongation retention (%) | L-value change rate (%) | Amount of fiber fragments during washing (mg/sheet material 100 $cm^2$) |
|---|---|---|---|---|
| Example 1 | 83 | 119 | 97 | 2.9 |
| Example 2 | 81 | 119 | 93 | 3.1 |
| Example 3 | 80 | 114 | 34 | 3.4 |
| Example 4 | 77 | 122 | 93 | 3.4 |

TABLE 3-2-continued

| | Wet tensile strength retention (%) | Wet tensile elongation retention (%) | L-value change rate (%) | Amount of fiber fragments during washing (mg/sheet material 100 $cm^2$) |
|---|---|---|---|---|
| Example 5 | 84 | 111 | 96 | 2.8 |
| Example 6 | 83 | 117 | 90 | 2.8 |
| Example 7 | 80 | 115 | 91 | 5.4 |
| Example 8 | 83 | 114 | 91 | 2.6 |

TABLE 3-2-continued

| | Wet tensile strength retention (%) | Wet tensile elongation retention (%) | L-value change rate (%) | Amount of fiber fragments during washing (mg/sheet material 100 $cm^2$) |
|---|---|---|---|---|
| Example 9 | 81 | 113 | 93 | 5.8 |
| Example 10 | 83 | 119 | 96 | 2.9 |

TABLE 4-2-continued

| | Wet tensile strength retention (%) | Wet tensile elongation retention (%) | L-value change rate (%) | Amount of fiber fragments during washing (mg/sheet material 100 $cm^2$) |
|---|---|---|---|---|
| Comparative Example 10 | 77 | 107 | 88 | 9.1 |

TABLE 4-1

| | Stiffness (mm) | Presence or absence of polyether bond | Presence or absence of polycarbonate bond | Presence or absence of N-acylurea bond/isourea bond | Appearance quality (Grade) | Wear resistance after DMF treatment (Wear loss (mg)/grade) |
|---|---|---|---|---|---|---|
| Comparative Example 1 | 81 | Presence | Absence | Presence | 5 | 33.5/2 |
| Comparative Example 2 | 92 | Absence | Presence | Presence | 3.5 | 29.9/2 |
| Comparative Example 3 | >150 | Presence | Presence | Presence | 2 | 7.4/4 |
| Comparative Example 4 | >150 | Presence | Presence | Presence | 2 | 7.1/4 |
| Comparative Example 5 | 122 | Presence | Presence | Presence | 2.5 | 8.0/4 |
| Comparative Example 6 | 84 | Presence | Presence | Presence | 1.5 | 21.2/3 |
| Comparative Example 7 | 138 | Presence | Presence | Presence | 2.5 | 7.8/4 |
| Comparative Example 8 | 86 | Presence | Presence | Presence | 1.5 | 32.7/3 |
| Comparative Example 9 | 96 | Presence | Presence | Absence | 3 | 32.0/2 |
| Comparative Example 10 | 98 | Presence | Presence | Presence | 2 | 19.5/3 |
| Comparative Example 11 | 97 | Presence | Presence | Presence | 3 | 42.7/2 |
| Comparative Example 12 | Absence | Absence | Absence | Absence | Absence | Absence |

TABLE 4-2

| | Wet tensile strength retention (%) | Wet tensile elongation retention (%) | L-value change rate (%) | Amount of fiber fragments during washing (mg/sheet material 100 $cm^2$) |
|---|---|---|---|---|
| Comparative Example 1 | 72 | 103 | 93 | 12.5 |
| Comparative Example 2 | 73 | 101 | 94 | 11.4 |
| Comparative Example 3 | 84 | 109 | 84 | 2.8 |
| Comparative Example 4 | 82 | 110 | 86 | 3.0 |
| Comparative Example 5 | 82 | 111 | 85 | 2.6 |
| Comparative Example 6 | 80 | 114 | 90 | 8.8 |
| Comparative Example 7 | 77 | 120 | 87 | 2.6 |
| Comparative Example 8 | 74 | 113 | 89 | 12.1 |
| Comparative Example 9 | 71 | 97 | 88 | 13.6 |

TABLE 4-2-continued

| | Wet tensile strength retention (%) | Wet tensile elongation retention (%) | L-value change rate (%) | Amount of fiber fragments during washing (mg/sheet material 100 $cm^2$) |
|---|---|---|---|---|
| Comparative Example 11 | 81 | 118 | 88 | 2.7 |
| Comparative Example 12 | Absence | Absence | Absence | Absence |

INDUSTRIAL APPLICABILITY

The sheet material of the present invention can be applied for furniture, chairs and wall coverings, seats in cabins of vehicles such as cars, trains and aircrafts, skin materials for ceilings and interiors, interior materials with a very elegant appearance, and clothing and industrial materials, and the like.

DESCRIPTION OF REFERENCE SIGNS

1: Floor surface
2: Inspection table
3: Sheet material
4: Line connecting position to be visually checked and sheet material
5: Position for visual check
6: Fluorescent lamp
7: Perpendicular line from sheet material to fluorescent lamp

The invention claimed is:

1. A sheet material comprising:
a fibrous base material made of ultrafine fibers;
a chain extender, and
an elastomer,
wherein an average single-fiber diameter of the ultrafine fibers is 0.1 μm or more and 10.0 μm or less,
wherein the chain extender comprises water, a low-molecular weight diol, an alicyclic diol, an aromatic diol, an aliphatic diamine, an alicyclic diamine, an aromatic diamine, an aroaliphatic diamine, an alkanolamine, hydrazine, a dihydrazide, or a mixture thereof;
the elastomer has a hydrophilic group and an N-acylurea bond and/or an isourea bond, and
the following condition 1 and condition 2 are satisfied:
condition 1: A longitudinal stiffness, in accordance with method A (45° cantilever method) in the text of "8.21 Stiffness" of JIS L 1096:2010 "Testing Methods for Woven and Knitted Fabrics", is 40 mm or more and 140 mm or less; and
condition 2: After immersion for 24 hours in N,N-dimethylformamide, the following are obtained in wear testing using a pressing load of 12.0 kPa and 20,000 friction cycles in accordance with method E (Martindale method) in the text of "8.19 Wear Strength and Friction Discoloration" of JIS L 1096:2010 "Testing Methods for Woven and Knitted Fabrics": a grade of at least 4 and a wear loss of not more than 25 mg.

2. The sheet material according to claim 1, wherein the elastomer includes two types of an elastomer A and an elastomer B different from the elastomer A.

3. The sheet material according to claim 1, wherein a wet tensile strength of the sheet material is 75% or more of a dry tensile strength of the sheet material.

4. The sheet material according to claim 1, wherein a wet tensile elongation of the sheet material is 100% or more of a dry tensile elongation of the sheet material.

5. The sheet material according to claim 1, wherein the sheet material further satisfies the following condition 3:
condition 3: The sheet material has an L value retention of 90% or more and 100% or less when a nap raising surface of the sheet material is placed on a hot plate heated to 150° C. and pressed at a pressing load of 2.5 kPa for 10 seconds.

6. The sheet material according to claim 1, wherein the sheet material further satisfies the following condition 4:
condition 4: In a washing test according to the ISO 6330 C4N method, when the washing test of one sheet of the sheet material is performed, and fiber fragments attached to a collecting bag attached to a drain hose after the test is collected using a membrane filter, an amount of the fiber fragment is 10.0 (mg/sheet material 100 $cm^2$) or less.

7. A method for producing a sheet material according to claim 1, comprising the following steps (1) to (3) in this order:
(1) A first elastomer precursor impregnation step of forming an elastomer by impregnating a fibrous base material made of ultrafine fiber-generating fibers with an aqueous dispersion containing an elastomer precursor having a hydrophilic group, a monovalent cation-containing inorganic salt, and a crosslinker, and then subjecting the fibrous base material impregnated with the aqueous dispersion to a heat drying treatment at a temperature of 100° C. or higher and 180° C. or lower, wherein a content of the monovalent cation-containing inorganic salt in the aqueous dispersion is 10 parts by mass or more and 100 parts by mass or less with respect to 100 parts by mass of the elastomer precursor;
(2) An ultrafine fiber generating step of generating ultrafine fibers from the ultrafine fiber-generating fibers to form a fibrous base material made of the ultrafine fibers; and
(3) A second elastomer precursor impregnation step of further forming an elastomer by impregnating a fibrous base material made of the ultrafine fibers with an aqueous dispersion containing an elastomer precursor having a hydrophilic group, a monovalent cation-containing inorganic salt, and a crosslinker, and then subjecting the fibrous base material impregnated with the aqueous dispersion to a heat drying treatment at a temperature of 100° C. or higher and 180° C. or lower, wherein a content of the monovalent cation-containing inorganic salt in the aqueous dispersion is 10 parts by mass or more and 100 parts by mass or less with respect to 100 parts by mass of the elastomer precursor.

8. The method for producing a sheet material according to claim 7, wherein the elastomer precursor used in the first elastomer precursor impregnation step and the elastomer precursor used in the second elastomer precursor impregnation step are the same elastomer precursor.

9. The method for producing a sheet material according to claim 7, wherein the elastomer precursor contains polyether diol and/or polycarbonate diol.

10. The method for producing a sheet material according to claim 7, wherein the elastomer precursor used in the first elastomer precursor impregnation step is an elastomer precursor A, and the elastomer precursor used in the second elastomer precursor impregnation step is an elastomer precursor B different from the elastomer precursor A.

11. The method for producing a sheet material according to claim 10, wherein the elastomer precursor A contains polyether diol as a constituent.

12. The method for producing a sheet material according to claim 10, wherein the elastomer precursor B contains polycarbonate diol as a constituent.

13. The method for producing a sheet material according to claim 7, wherein the crosslinker is a carbodiimide-based crosslinker and/or a blocked isocyanate crosslinker.

14. The method for producing a sheet material according to claim 7, wherein the monovalent cation-containing inorganic salt is sodium chloride and/or sodium sulfate.

15. The sheet material of claim 1, wherein:
the low-molecular-weight diol comprises ethylene glycol, propylene glycol, 1,3-butylene glycol, 1,4-butanediol, 1,6-hexanediol, diethylene glycol, or neopentyl glycol;
the alicyclic diol comprises 1,4-bis(hydroxymethyl)cyclohexane;
the aromatic diol comprises 1,4-bis(hydroxyethyl)benzene;

the aliphatic diamine comprises ethylenediamine;
the alicyclic diamine comprises isophorondiamine;
the aromatic diamine comprises 4-4-diaminodiphenyl-methane;
the aroaliphatic diamine comprises xylenediamine;
the alkanolamine comprises ethanolamine; and,
the dihydrazide comprises adipic acid dihydrazide.

* * * * *